US010165373B2

(12) United States Patent
Bertelsen et al.

(10) Patent No.: US 10,165,373 B2
(45) Date of Patent: Dec. 25, 2018

(54) HEARING DEVICE COMPRISING A BEAMFORMER FILTERING UNIT

(71) Applicant: Oticon A/S, Smørum (DK)

(72) Inventors: Andreas Thelander Bertelsen, Smørum (DK); Michael Syskind Pedersen, Smørum (DK); Jesper Jensen, Smørum (DK); Thomas Kaulberg, Smørum (DK); Morten Christophersen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/482,188

(22) Filed: Apr. 7, 2017

(65) Prior Publication Data

US 2017/0295437 A1 Oct. 12, 2017

(30) Foreign Application Priority Data

Apr. 8, 2016 (EP) ..... 16164353

(51) Int. Cl.
*H04R 25/00* (2006.01)
*G10L 21/0232* (2013.01)
*G10L 21/0216* (2013.01)

(52) U.S. Cl.
CPC ..... *H04R 25/407* (2013.01); *G10L 21/0232* (2013.01); *H04R 25/353* (2013.01);
(Continued)

(58) Field of Classification Search
CPC .. H04R 25/407; H04R 25/558; H04R 25/353; H04R 25/405; H04R 25/552;
(Continued)

(56) References Cited

U.S. PATENT DOCUMENTS 9,301,049 B2 * 3/2016 Elko ..... H04R 3/005
2010/0196861 A1 8/2010 Lunner
2014/0185826 A1 7/2014 Tawada

FOREIGN PATENT DOCUMENTS

EP 2 701 145 A1 2/2014
EP 2 884 763 A1 6/2015
(Continued)

*Primary Examiner* — Brian Ensey
(74) *Attorney, Agent, or Firm* — Birch, Stewart, Kolasch & Birch, LLP

(57) ABSTRACT

A hearing aid comprises a) first and second microphones b) an adaptive beamformer filtering unit comprising, b1) a first and second memories comprising a first and second sets of complex frequency dependent weighting parameters representing a first and second beam patterns, where said first and second sets of weighting parameters are predetermined initial values or values updated during operation of the hearing aid, b3) an adaptive beamformer processing unit providing an adaptation parameter $\beta_{opt}(k)$ representing an adaptive beam pattern configured to attenuate unwanted noise under the constraint that sound from a target direction is essentially unaltered, b4) a third memory comprising a fixed adaptation parameter $\beta_{fix}(k)$ representing a third, fixed beam pattern, b5) a mixing unit providing a resulting complex, frequency dependent adaptation parameter $\beta_{mix}(k)$ as a combination of said fixed and adaptively determined frequency dependent adaptation parameters $\beta_{fix}(k)$ and $\beta_{opt}(k)$, respectively, and b6) a resulting beamformer (Y) for providing a resulting beamformed signal $Y_{BF}$ based on first and second microphone signals, said first and second sets of complex frequency dependent weighting parameters, and said resulting complex, frequency dependent adaptation parameter $\beta_{mix}(k)$.

17 Claims, 14 Drawing Sheets
(1 of 14 Drawing Sheet(s) Filed in Color)

(52) U.S. Cl.
CPC ..... *H04R 25/405* (2013.01); *H04R 25/558* (2013.01); *G10L 2021/02166* (2013.01); *H04R 25/552* (2013.01); *H04R 25/554* (2013.01); *H04R 25/606* (2013.01); *H04R 2225/41* (2013.01); *H04R 2225/43* (2013.01); *H04R 2225/61* (2013.01); *H04R 2430/20* (2013.01)

(58) Field of Classification Search
CPC ..... H04R 25/554; H04R 25/606; H04R 2225/41; H04R 2225/43; H04R 2225/61; G10L 2021/0232; G10L 2021/02166
See application file for complete search history.

(56) References Cited

FOREIGN PATENT DOCUMENTS

| | | | |
|---|---|---|---|
| EP | 2 993 915 | A1 | 3/2016 |
| GB | 2517823 | A | 3/2015 |
| WO | WO 2007/106399 | A2 | 9/2007 |
| WO | WO 2007/106399 | A3 | 9/2007 |

* cited by examiner

D

E

F

HEARING DEVICE COMPRISING A BEAMFORMER FILTERING UNIT

SUMMARY

The present disclosure deals with hearing devices, e.g. hearing aids, in particular with spatial filtering of sound impinging on microphones of the hearing aid.

Directionality obtained by beamforming in hearing aids is an efficient way to attenuate unwanted noise as a direction-dependent gain can cancel noise from one direction while preserving the sound of interest impinging from another direction hereby potentially improving the speech intelligibility. Typically beamformers in hearing instruments have beam patterns, which are continuously adapted in order to minimize the noise while sound impinging from the target direction is unaltered.

Despite the potential benefit, directionality also has some drawbacks. The consequence of removing noise may possibly also remove some sounds of interest. Adaptive beamformers have the potential of completely removing sounds from certain directions. Hereby the ability of maintaining awareness on all sounds has been taken away from the listener. In very noisy environments this beamformer behaviour may be desirable in order to maintain intelligibility, but in less noisy environments, such a beamformer is less desirable as the listener prefer the ability to being aware of sounds from all directions.

Thus, the provision of a controllable ability to reduce the effect of the beam pattern in order to achieve a trade-off between attenuating unwanted noise and maintaining awareness of all sound sources is desired.

A Hearing Aid:

In an aspect of the present application, a hearing aid adapted for being located in an operational position at or in or behind an ear or fully or partially implanted in the head of a user is provided. The hearing aid comprises

- first and second microphones for converting an input sound to first $IN_1$ and second $IN_2$ electric input signals, respectively,
- an adaptive beamformer filtering unit (BFU) for providing a resulting beamformed signal $Y_{BF}$, based on said first and second electric input signals, the adaptive beamformer filtering unit comprising,
- a first memory comprising a first set of complex frequency dependent weighting parameters $W_{o1}(k)$, $W_{o2}(k)$ representing a first beam pattern (O), where k is a frequency index, k=1, 2, . . . , K,
- a second memory comprising a second set of complex frequency dependent weighting parameters $W_{c1}(k)$, $W_{c2}(k)$ representing a second beam pattern (C),
- where said first and second sets of weighting parameters $W_{o1}(k)$, $W_{o2}(k)$ and $W_{c1}(k)$, $W_{c2}(k)$, respectively, are predetermined (initial values) and/or (possibly) values updated during operation of the hearing aid,
- an adaptive beamformer processing unit for providing an adaptively determined adaptation parameter $\beta_{opt}(k)$ representing an adaptive beam pattern (OPT) configured to attenuate unwanted noise (as much as possible) under the constraint that sound from a target direction is (essentially) unaltered (by the adaptation parameter $\beta_{opt}(k)$),
- a third memory comprising a fixed adaptation parameter $\beta_{fix}(k)$ representing a third, fixed beam pattern (OO),
- a mixing unit configured to provide a resulting complex, frequency dependent adaptation parameter $\beta_{mix}(k)$ as a combination of said fixed frequency dependent adaptation parameter $\beta_{fix}(k)$ and said adaptively determined frequency dependent adaptation parameter $\beta_{opt}(k)$, and
- a resulting beamformer (Y) for providing said resulting beamformed signal $Y_{BF}$ based on said first and second electric input signals $IN_1$ and $IN_2$, said first and second sets of complex frequency dependent weighting parameters $W_{o1}(k)$, $W_{o2}(k)$ and $W_{c1}(k)$, $W_{c2}(k)$, and said resulting complex, frequency dependent adaptation parameter $\beta_{mix}(k)$.

Thereby an improved hearing aid may be provided.

The term under the constraint that sound from a target direction is 'essentially unaltered' is taken to mean that sound from a target direction is unaltered (by the adaptation parameter $\beta_{opt}(k)$, or at least as unaltered as possible), at least at a single frequency.

In an embodiment, the resulting adaptation parameter $\beta_{mix}$ is determined as a function of the fixed frequency dependent adaptation parameter $\beta_{fix}(k)$, the adaptively determined frequency dependent adaptation parameter $\beta_{opt}(k)$, and a weighting parameter $\alpha$, $\beta_{mix}=f(\beta_{fix}(k), \beta_{opt}(k), \alpha)$. In an embodiment, the weighting parameter $\alpha$ is a real number between 0 and 1.

In an embodiment, the adaptively determined adaptation parameter $\beta_{opt}(k)$ and said fixed adaptation parameter $\beta_{fix}(k)$ are based on said first and second sets of complex frequency dependent weighting parameters $W_{o1}(k)$, $W_{o2}(k)$ and $W_{c1}(k)$, $W_{c2}(k)$, respectively.

In an embodiment, hearing aid comprises a control unit for dynamically controlling the relative weighting of the fixed and adaptively determined adaptation parameters $\beta_{fix}(k)$ and $\beta_{opt}(k)$, respectively.

In an embodiment, the resulting beamformed signal $Y_{BF}$ is determined according to the following expression:

$$Y_{BF}=IN_1(k)\cdot(W_{o1}(k)^*-\beta_{min}(k)\cdot W_{c1}(k)^*)+IN_2(k)\cdot(W_{o2}(k)^*-\beta_{mix}(k)\cdot W_{c2}(k)^*),$$

where * denotes complex conjugation. In a short, 'beam pattern notation', this can be written as $Y_{BF}=Y=O-\beta_{mix}C$. In other words, the resulting beamformer (Y) is a weighted combination of the first and second beam patterns O and C: $Y(k)=O(k)-\beta_{mix}(k)\cdot C(k)$, where $\beta_{mix}(k)$ is the complex, frequency dependent adaptation parameter. Based thereon the resulting beamformed signal $Y_{BF}$ is provided.

In an embodiment, the first beam pattern (O) represents the beam pattern of a delay and sum beamformer and wherein said second beam pattern (C) represents a beam pattern of a delay and subtract beamformer (C). In an embodiment, the first beam pattern (O) represents an all-pass (omni-directional) beam pattern. In an embodiment, the second beam pattern (C) represents a target-cancelling beam pattern. Preferably, O and C are orthogonal ($w_o^H w_c=0$).

The present beamformer structure ($Y=O-\beta_{mix}C$) has the advantage that the factor $\beta_{mix}$ responsible for noise reduction is only multiplied on the second (target-cancelling) beam pattern C (so that the signal received from the target direction is not affected by any value of $\beta_{mix}$). This constraint of a Minimum Variance Distortionless Response (MVDR) beamformer is a built in feature of the generalized sidelobe canceller (GSC) structure.

In an embodiment, the second beam pattern (C) is configured to have maximum attenuation in a direction of a target signal source (termed 'the target direction'). In an embodiment, the direction to the target signal source is determined relative to an axis (the 'microphone axis') through the first and second microphones (e.g. through their geometrical centres). In an embodiment, the direction to the target signal source is configurable, e.g. determined by the user via a user interface, or selectable by selection among a number of predetermined directions (e.g. in front of, to the rear of, to the left of, to the right of the user), or automatically selected, e.g. via identification of a direction to a dominant audio source, e.g. an audio source comprising a voice, e.g. speech. In an embodiment, the second set of weighting parameters $W_{c1}(k)$, $W_{c2}(k)$, are derived from the first set of weighting parameters $W_{o1}(k)$, $W_{o2}(k)$. In an embodiment, $W_{c1}(k)=1-W_{o1}(k)$, and $W_{c2}(k)=-W_{o2}(k)$.

In an embodiment, the hearing aid is configured to provide that the direction to the target signal source relative to a predefined direction is configurable.

In an embodiment, the first and second sets of weighting parameters $W_{o1}(k)$, $W_{o2}(k)$ and $W_{c1}(k)$, $W_{c2}(k)$, respectively, are updated during operation of the hearing aid. In an embodiment, the weighting parameters $W_{o1}(k)$, $W_{o2}(k)$ and $W_{c1}(k)$, $W_{c2}(k)$, respectively, are updated in response to a modification of the direction to the target signal source.

In an embodiment, the adaptation parameter $\beta_{opt}(k)$ is determined from the following expression $$\beta_{opt} = \frac{\langle C * O \rangle}{\langle |C|^2 \rangle},$$

where * denotes complex conjugation, and <·> denotes the statistical expectation operator. In an embodiment, the adaptive beamformer is a Minimum Variance Distortionless Response (MVDR) type beamformer, as e.g. described in EP2701145A1. In an embodiment, $\langle C*O \rangle$ and $\langle |C|^2 \rangle$ are determined during speech pauses (VAD=0).

In a more general embodiment (based on the generalized sidelobe canceller structure, GSC), the adaptation parameter $\beta_{opt}(k)$ is determined from the following expression $$\beta_{opt} = \frac{w_O^H C_v w_C}{w_C^H C_v w_C},$$

where $w_O=(w_{o1}, w_{o2})^T$ and $w_C$ $(w_{o1}, w_{o2})^T$ are the beamformer weights (also termed 'frequency dependent weighting parameters') for the delay and sum O and delay and subtract C beamformers, respectively, $C_v=\langle IN \cdot IN^H \rangle$, $IN=(IN1, IN2)^T$, is the noise covariance matrix determined during speech pauses, and H denotes Hermitian transposition (H=T*, where T denotes transposition and * denotes complex conjugate).

The above two expressions for $\beta_{opt}$ reflect that it is possible to determine β either directly from the signals/beam patterns (O, C), or from the noise covariance matrix $C_v$. Either way of determining $\beta_{opt}$ may have its advantages. In cases where signals (O, C) are used other places in the device in question, it may be advantageous to derive β directly from these signals (first expression for β). If, however, the beamformers (O, C) are changed, e.g. adaptively updated, e.g. if the look direction is changed (and hereby $w_O$ and $w_C$), it is a disadvantage that the weights are included inside the expectation operator. In that case, it is an advantage to derive β directly from the noise covariance matrix (second expression for β).

In an embodiment, the third, fixed beam pattern (OO) is configured to provide a fixed beam pattern having a desired directional shape suitable for listening to sounds from all directions. In an embodiment, the third fixed beamformer (OO) is configured to provide an omni-directional response or a response (at least at relatively low frequencies, such as at all frequencies considered the hearing aid) which closer mimics the directional response of a human ear.

In an embodiment, the beamformer filtering unit is configured to allow a fading between two different beam patterns: A) An optimized adaptive beam pattern equal to the beam pattern provided by the adaptation parameter $\beta_{opt}(k)$ (optimal in the sense of attenuating unwanted noise as much as possible under the constraint that sound from the look direction is essentially unaltered); and B) a fixed beam pattern (represented by the adaptation parameter $\beta_{fix}(k)$) (e.g. configured to provide a fixed beam pattern having a desired directional shape suitable for listening to sounds from all directions). In an embodiment, fading between the two different beam patterns A) and B) is provided by an adaptively calculated resulting adaptation parameter $\beta_{mix}$ that is allowed to vary between $\beta_{opt}(k)$ and $\beta_{fix}(k)$.

In an embodiment, the resulting adaptation parameter $\beta_{mix}$ is determined as a linear combination of the adaptation parameters $\beta_{opt}$ and $\beta_{fix}$ according to the expression $$\beta_{mix}=\alpha\beta_{opt}+(1-\alpha)\beta_{fix},$$

where the weighting parameter α is a real number between 0 and 1. This has the advantage of providing a computationally simple solution. In an embodiment, $\beta_{mix}=w_1\beta_{opt}+w_2\beta_{fix}$, where $w_1$ and $w_2$ are complex or real weighting factors.

In an embodiment, the resulting adaptation parameter $\beta_{mix}$ is determined as belonging to points on a circle in the complex plane. In an embodiment, the resulting adaptation parameter $\beta_{mix}$ is determined by points on a circle centered at $$\left(0, \frac{\beta_{opt}+\beta_{fix}}{2}\right)$$

and having a radius of $$\frac{|\beta_{opt}-\beta_{fix}|}{2}$$

In an embodiment, the resulting adaptation parameter $\beta_{mix}$ is determined according to the expression $$\beta_{mix} = \frac{|\beta_{opt}-\beta_{fix}|}{2}(\cos(\pi\alpha + \angle(\beta_{opt}-\beta_{fix})) + j\sin(\pi\alpha + \angle(\beta_{opt}-\beta_{fix}))) + \frac{\beta_{opt}+\beta_{fix}}{2},$$

where α is a real number between 0 and 1. In an embodiment, the resulting adaptation parameter $\beta_{mix}$ is determined according to the expression $$\beta_{mix} = \frac{|\beta_{opt}-\beta_{fix}|}{2}(\cos(\pi\alpha + \angle(\beta_{fix}-\beta_{opt})) + j\sin(\pi\alpha + \angle(\beta_{fix}-\beta_{opt}))) + \frac{\beta_{opt}+\beta_{fix}}{2},$$

where α is a real number between 0 and 1. This has the advantage that the minimum in the polar response of the resulting beamformer Y is maintained in the same spatial direction during the fading of the resulting adaptation parameter $\beta_{mix}$ between $\beta_{opt}$ and $\beta_{fix}$.

In an embodiment, the weighting parameter $\alpha$ is constant and independent of frequency. In an embodiment, the weighting parameter $\alpha$ is frequency dependent ($\alpha=\alpha(k)$). In an embodiment, the weighting parameter $\alpha$ is frequency dependent, but constant within a frequency band k.

In an embodiment, the weighting parameter $\alpha$ is a function of a current acoustic environment and/or of a present cognitive load of the user. In an embodiment, the control unit is configured to adaptively control the weighting parameter $\alpha$ depending on a characteristic of the electric input signal(s), e.g. on one or more of input level, estimated signal-to-noise ratio (SNR), a noise floor level, a voice activity indication, an own voice activity indication, a target-to-jammer ratio (TJR). In an embodiment, the control unit is configured to adaptively control the weighting parameter $\alpha$ depending on one or more detectors, e.g. environmental detectors. In an embodiment, the hearing aid is adapted to receive control signals from one or more detectors external to the hearing aid, e.g. from a smartphone or similar device or from an individual detector or information provider, e.g. via a wireless interface, e.g. based on Bluetooth Low Energy, or similar technology. In an embodiment, said detectors comprise one or more detectors of a user's physical and/or mental state, e.g. a movement sensor, a detector of present cognitive load, a detector of accumulated acoustic dose, etc. In an embodiment, the control unit is configured to adaptively control the weighting parameter $\alpha$ depending on an estimate of a present cognitive load, e.g. acoustic load, of the user. The weight could also depend on an estimate on the user's fatigue, e.g. depending on an estimate on the amount of sound exposed to the user during the day. In an embodiment, the control unit is configured to adaptively control the weighting parameter $\alpha$ depending on an estimated direction to a current target sound source or on chosen beamformer weights $w_O$, $w_C$. This way of mixing between the two beam patterns has the advantage that we do not have to actually calculate the two beam patterns as the resulting beam pattern is achieved solely by a modification of the control parameter $\beta$. The control of signal processing, e.g. directionality, in dependence of an estimate of a present cognitive load of the user is e.g. discussed in US2010196861A1. In an embodiment, the present cognitive load includes an estimate of the accumulated acoustic dose over a predetermined period of time, e.g. the last 2 hours, the last 4 hours, e.g. the last 8 hours, e.g. since the last power-on of the hearing aid.

In an embodiment, the hearing aid comprises a hearing instrument, a headset, an earphone, an ear protection device or a combination thereof.

In an embodiment, the hearing aid comprises an output unit (e.g. a loudspeaker, or a vibrator or electrodes of a cochlear implant) for providing output stimuli perceivable by the user as sound. In an embodiment, the hearing aid comprises a forward or signal path between the first and second microphones and the output unit. The beamformer filtering unit is located in the forward path. In an embodiment, a signal processing unit is located in the forward path. In an embodiment, the signal processing unit is adapted to provide a level and frequency dependent gain according to a user's particular needs. In an embodiment, the hearing aid comprises an analysis path comprising functional components for analyzing the electric input signal(s) (e.g. determining a level, a modulation, a type of signal, an acoustic feedback estimate, etc.). In an embodiment, some or all signal processing of the analysis path and/or the forward path is conducted in the frequency domain. In an embodiment, some or all signal processing of the analysis path and/or the forward path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing aids comprise an analogue-to-digital (AD) converter to digitize an analogue input with a predefined sampling rate, e.g. 20 kHz. In an embodiment, the hearing aids comprise a digital-to-analogue (DA) converter to convert a digital signal to an analogue output signal, e.g. for being presented to a user via an output transducer.

In an embodiment, the hearing aid, e.g. the first and second microphones each comprises a (TF-)conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing aid from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing aid is split into a number NI of frequency bands, where NI is e.g. larger than 5, such as larger than 10, such as larger than 50, such as larger than 100, such as larger than 500, at least some of which are processed individually. In an embodiment, the hearing aid is/are adapted to process a signal of the forward and/or analysis path in a number NP of different frequency channels (NP≤NI). The frequency channels may be uniform or non-uniform in width (e.g. increasing in width with frequency), overlapping or non-overlapping. Each frequency channel comprises one or more frequency bands.

In an embodiment, the hearing aid comprises a hearing instrument, e.g. a hearing instrument adapted for being located at the ear or fully or partially in the ear canal of a user, or for being fully or partially implanted in the head of the user.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the number of detectors comprises a noise floor detector. In an embodiment, the number of detectors comprises a telephone mode detector.

In a particular embodiment, the hearing aid comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. In an embodiment, the voice activity detector is adapted to differentiate between a user's own voice and other voices.

In an embodiment, the hearing aid comprises an own voice detector for detecting whether a given input sound (e.g. a voice) originates from the voice of the user of the system. In an embodiment, the microphone system of the hearing aid is adapted to be able to differentiate between a user's own voice and another person's voice and possibly from NON-voice sounds.

In an embodiment, the memory comprise a number of fixed adaptation parameter $\beta_{fix,j}(k)$, j=1, . . . , $N_{fix}$, where $N_{fix}$ is the number of fixed beam patterns, representing different (third) fixed beam patterns, which may be selected in dependence of a control signal, e.g. from a user interface or based on a signal from one or more detectors. In an embodiment, the choice of fixed beamformer is dependent on a signal from the own voice detector and/or from a telephone mode detector.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing aid.

In an embodiment, the hearing aid further comprises other relevant functionality for the application in question, e.g. compression, noise reduction, feedback suppression, etc.

In an embodiment, the hearing aid comprises a hearing instrument, e.g. a hearing instrument adapted for being located at the ear or fully or partially in the ear canal of a user or fully or partially implanted in the head of a user, a headset, an earphone, an ear protection device or a combination thereof.

Use:

In an aspect, use of a hearing aid as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of constraining an adaptive beamformer for providing a resulting beamformed signal $Y_{BF}$ of a hearing aid is furthermore provided by the present application. The method comprises Providing first and second complex frequency dependent weighting parameters $W_{o1}(k)$, $W_{o2}(k)$, and $W_{c1}(k)$, $W_{c2}(k)$, respectively, representing first and second beam patterns (O) and (C), respectively, where k is a frequency index, k=1, 2, . . . , K, Providing an adaptively determined adaptation parameter $\beta_{opt}(k)$ representing an adaptive beam pattern (OPT) configured to attenuate unwanted noise (as much as possible) under the constraint that sound from a target direction is (essentially) unaltered (by the adaptation parameter $\beta_{opt}(k)$), Providing a fixed adaptation parameter $\beta_{fix}(k)$ representing a third fixed beam pattern (OO), Providing a complex, frequency dependent adaptation parameter $\beta_{mix}(k)$ as a combination of said fixed frequency dependent adaptation parameter $\beta_{fix}(k)$ and said adaptively determined frequency dependent adaptation parameter $\beta_{opt}(k)$, Providing a resulting beamformer (Y) as a weighted combination of said first and second beam patterns O and C: $Y(k)=O(k)-\beta(k)\cdot C(k)$, where $\beta_{mix}(k)$ is said complex, frequency dependent adaptation parameter, and providing said resulting beamformed signal $Y_{BF}$.

The expression $Y(k)=O(k)-\beta_{mix}(k)\cdot C(k)$, may also be written as $Y_{BF}(k)=(w_o(k)-\beta^*_{mix}(k)\cdot w_c(k))^H\cdot IN(k)$, where IN(k) are the input signals (e.g. IN1, IN2 in FIG. 6E), because $O=w_o^H IN$, $C=w_c^H IN$, so $O-\beta C=w_o^H IN-\beta w_c^H IN.=(w_o^H-\beta w_c^H)IN$.

Thereby a resulting beamformed signal $Y_{BF}$ based on first and second electric input signals and said first, second and third fixed beam patterns, said adaptive beam pattern, and said resulting beamformer is provided.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises that the adaptively determined adaptation parameter $\beta_{opt}(k)$ as well as the fixed adaptation parameter $\beta_{fix}(k)$ are based on the first and second sets of complex frequency dependent weighting parameters $W_{o1}(k)$, $W_{o2}(k)$ and $W_{c1}(k)$, $W_{c2}(k)$.

In an embodiment, the method comprises dynamically controlling the relative weighting of the fixed and adaptively determined adaptation parameters $\beta_{fix}(k)$ and $\beta_{opt}(k)$, respectively.

A Computer Program:

A computer program (product) comprising instructions which, when the program is executed by a computer, cause the computer to carry out (steps of) the method described above, in the 'detailed description of embodiments' and in the claims is furthermore provided by the present application.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid. In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

In an embodiment, the auxiliary device is another hearing aid. In an embodiment, the hearing system comprises two hearing aids adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' may refer to a system comprising one or two hearing aids or one or two hearing aids and an auxiliary device, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing instruments, headsets, ear phones, active ear protection systems, or combinations thereof.

BRIEF DESCRIPTION OF DRAWINGS

The patent or application file contains at least one color drawing. Copies of this patent or patent application publication with color drawing will be provided by the USPTO upon request and payment of the necessary fee.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, specifically to spatial filtering and a hearing aid comprising an adaptive beamformer filtering unit.

Figure 1:
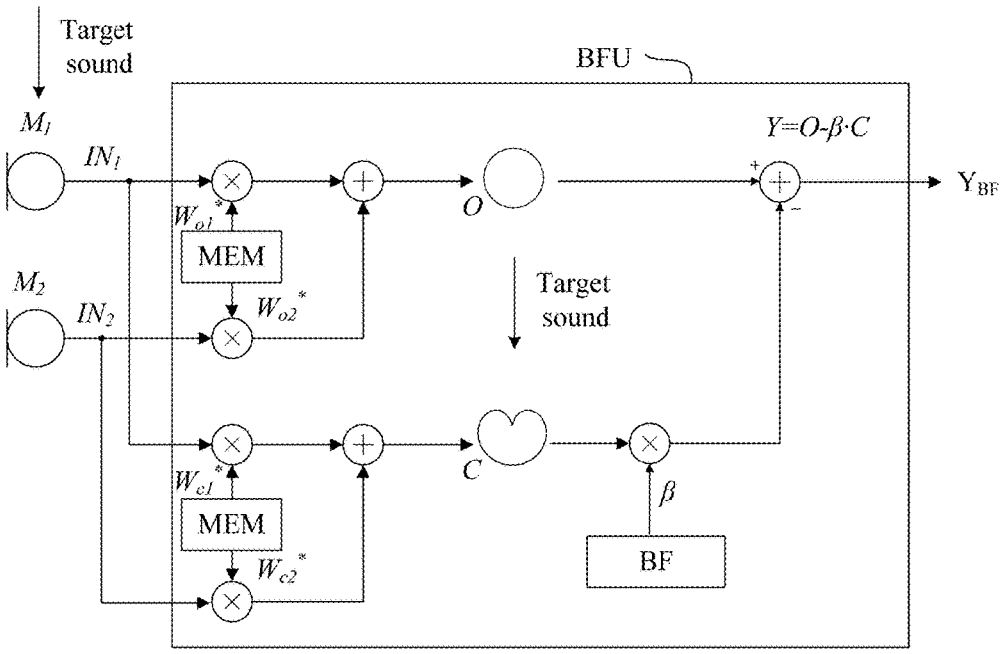
FIG. 1 shows an embodiment of an adaptive beamformer filtering unit for providing a beamformed signal based on two microphone inputs.

An example explaining the basic idea is outlined in the following with reference to FIG. 1. FIG. 1 shows a part of a hearing aid comprising first and second microphones ($M_1$, $M_2$) providing respective first and second electric input signals $IN_1$ and $IN_2$, respectively and a beamformer filtering unit (BFU) show providing a beamformed signal $Y_{BF}$ based on the first and second electric input signals. A direction from the target signal to the hearing aid is e.g. defined by the microphone axis and indicated in FIG. 1 by arrow denoted Target sound. The target direction can be any direction, e.g. a direction to the user's mouth (to pick up the user's own voice). An adaptive beam pattern (Y(Y(k))), for a given frequency band k, k being a frequency band index, is obtained by linearly combining an omnidirectional delay-and-sum-beamformer (O(O(k))) and a delay-and-subtract-beamformer (C(C(k))) in that frequency band. The adaptive beam pattern arises by scaling the delay-and-subtract-beamformer (C(k)) by a complex-valued, frequency-dependent, adaptive scaling factor β(k) (generated by beamformer BF) before subtracting it from the delay-and-sum-beamformer (O(k)), i.e. providing the beam pattern Y, $$Y(k)=O(k)-\beta(k)C(k).$$

It should be noted that the sign in front of β(k) might as well be +, if the sign(s) of the weights constituting the delay-and-subtract beamformer C is appropriately adapted. Further, β(k) may be substituted by β*(k), where * denotes complex conjugate, such that the beamformed signal $Y_{BF}$ is expressed as $Y_{BF}=(w_o(k)-\beta(k)\cdot w_c(k))^H\cdot IN(k)$.

The beamformer filtering unit (BFU) is e.g. adapted to work optimally in situations where the microphone signals consist of a point-noise target sound source in the presence of additive noise sources. Given this situation, the scaling factor β(k) (β in FIG. 1) is adapted to minimize the noise under the constraint that the sound impinging from the target direction (at least at one frequency) is essentially unchanged. For each frequency band k, the adaptation factor β(k) can be found in different ways. The solution may be found in closed form as $$\beta(k)=\frac{\langle C^*O\rangle}{\langle |C|^2\rangle},$$

where * denote the complex conjugation and ⟨·⟩ denotes the statistical expectation operator, which may be approximated in an implementation as a time average. The expectation operator ⟨·⟩ may be implemented using e.g. a first order IIR filter, possibly with different attack and release time constants. Alternatively, the expectation operator may be implemented using an FIR filter.

In a further embodiment, the adaptive beamformer processing unit is configured to determine the adaptation parameter $\beta_{opt}(k)$ from the following expression $$\beta_{opt}=\frac{w_O^H C_v w_C}{w_C^H C_v w_C},$$

where $w_O$ and $W_C$ are the beamformer weights for the delay and sum O and the delay and subtract C beamformers, respectively, $C_v$ is the noise covariance matrix, and H denotes Hermetian transposition.

As an alternative, the adaptation factor may be updated by an LMS or NLMS equation:

$$\beta(n,k)=\beta(n-1,k)+\mu\frac{C^*Y-\varepsilon\beta(n-1,k)}{|C|^2},$$

where n denotes a frame index, and μ is the learning rate (step size) of the algorithm, and ϵ is a selected constant, typically with the value 0. Obviously, any other adaptive updating strategy, e.g., based on recursive least-squares, etc., may be used.

For a given frequency band k, let $h_{\theta_0}(k)$ denote a 2×1 complex-valued vector of acoustic transfer functions from a sound source located in direction $\theta_0$ to each microphone. In the following we omit the frequency band index k and $\theta_0$, and simply write $h \equiv h_{\theta_0}(k)$. Let us first define a normalized look vector d as $$d = [\, d_1 \quad d_2 \,]^T = \frac{h}{\sqrt{h^H h}}$$

where T denotes transposition, and H denotes conjugate transposition. The omnidirectional beamformer O is achieved by applying possibly complex weights (or filter coefficients) to each of the microphone signals ($IN_1$, $IN_2$). Omnidirectional beamformer weights $wo=[wo_1 \; wo_2]^T$ are calculated as $$wo = dd^*_{ref},$$

where $d^*_{ref}$ is a complex-valued scalar corresponding to a spatial reference position. For simplicity, we choose the reference position as the position of the first microphone, i.e. $d^*_{ref}=d^*_1$ such that $wo=dd^*_1$.

Like the omnidirectional beamformer O, the delay-and-subtract beamformer C is achieved by applying possibly complex weights (or filter coefficients) to each of the microphone signals ($IN_1$, $IN_2$). The delay-and-subtract beamformer C is selected as a target cancelling beamformer, and its corresponding weights $wc=[wc_1 \; wc_2]^T$ are found as in [Jensen & Pedersen; 2015]

$$wc = \begin{bmatrix} 1 \\ 0 \end{bmatrix} - dd_1^*.$$

In terms of the acoustic transfer functions, we can write $$wo_1 = \frac{h_1 h_1^*}{|h_1|^2 + |h_2|^2} = \frac{|h_1|^2}{|h_1|^2 + |h_2|^2}$$

$$wo_2 = \frac{h_2 h_1^*}{|h_1|^2 + |h_2|^2}$$

$$wc_1 = 1 - \frac{|h_1|^2}{|h_1|^2 + |h_2|^2}$$

$$wc_2 = -\frac{h_2 h_1^*}{|h_1|^2 + |h_2|^2}$$

We term the microphone signal obtained by the first microphone $x_1$ ($IN_1$ in FIG. 1) and the microphone signal obtained by the second microphone $x_2$ ($IN_2$ in FIG. 1). We thus have $$O = wo^H x = x_1\left(\frac{|h_1|^2}{|h_1|^2 + |h_2|^2}\right)^* + x_2\left(\frac{h_2 h_1^*}{|h_1|^2 + |h_2|^2}\right)^*$$

$$C = wc^H x = x_1\left(1 - \frac{|h_1|^2}{|h_1|^2 + |h_2|^2}\right)^* - x_2\left(\frac{h_2 h_1^*}{|h_1|^2 + |h_2|^2}\right)^*$$

It should be noted that to minimize computation, the complex conjugated values of the weights (e.g. $wc_1^*$, $wc_2^*$) may be stored in the memory instead of the weights themselves (e.g. $wc_1$, $wc_2$). We now consider free-field conditions, where we can describe the difference between the microphones in terms of a direction-dependent time delay, i.e.

$$h = \begin{bmatrix} 1 \\ e^{-j\frac{\omega d}{c}\cos\theta} \end{bmatrix},$$

where ω=2πf is the angular frequency, d is the microphone distance, c is the sound velocity, and θ is the azimuth. For a given look vector $\theta_0$ we thus have the response $$h_0 = \begin{bmatrix} 1 \\ e^{-j\frac{\omega d}{c}\cos\theta_0} \end{bmatrix},$$

The corresponding beamformer weights thus become $$wo = \begin{bmatrix} \frac{1}{2} \\ \frac{e^{-j\frac{\omega d}{c}\cos\theta_0}}{2} \end{bmatrix},$$

$$wc = \begin{bmatrix} \frac{1}{2} \\ -\frac{e^{-j\frac{\omega d}{c}\cos\theta_0}}{2} \end{bmatrix},$$

The free field impulses response of the delay and sum beamformer O and the delay and subtract beamformer C thus become, respectively $$O = \begin{bmatrix} \frac{1}{2} \\ \frac{e^{-j\frac{\omega d}{c}\cos\theta_0}}{2} \end{bmatrix}^H \begin{bmatrix} 1 \\ e^{-j\frac{\omega d}{c}\cos\theta} \end{bmatrix} = \frac{1 + e^{j\frac{\omega d}{c}(\cos\theta_0 - \cos\theta)}}{2}$$

$$C = \begin{bmatrix} \frac{1}{2} \\ -\frac{e^{-j\frac{\omega d}{c}\cos\theta_0}}{2} \end{bmatrix}^H \begin{bmatrix} 1 \\ e^{-j\frac{\omega d}{c}\cos\theta} \end{bmatrix} = \frac{1 - e^{j\frac{\omega d}{c}(\cos\theta_0 - \cos\theta)}}{2}$$

We write the magnitude squared response of the adaptive beamformer as $$|Y(k)|^2 = (O(k) - \beta(k)C(k))^*(O(k)) - \beta(k)C(k)).$$

For simplicity, we assume that the frequency band k only contains a single frequency (or we assume that the response of the frequency band can be described in terms of the center frequency of the frequency band, which is valid for narrow frequency bands and when the frequency is not too close to zero), i.e.

$$R(\omega) = |Y(\omega)|^2 = (O(\omega) - \beta(\omega)C(\omega))^*(O(\omega) - \beta(\omega)C(\omega)).$$

Inserting the equations above, we achieve the following magnitude squared response:

$$R(\omega,\theta) = \tfrac{1}{2}(1 + \cos A + |\beta|^2(1 - \cos A) - 2\Im\beta \sin A),$$

where $$A = \frac{\omega d}{c}(\cos\theta_0 - \cos\theta),$$

and $\Im\langle\cdot\rangle$ denotes the imaginary part of $\langle\cdot\rangle$. The magnitude squared response becomes 0, when $$\beta = \frac{j}{\tan\frac{A}{2}}.$$

Thus, the optimal complex value of β in terms of attenuating a point source from a given direction θ will thus be located at the imaginary axis.

Therefore under the free field conditions, if β is not located at the imaginary axis, the beam pattern will not contain a null direction. The beam pattern will however still have a direction θ with maximum attenuation. In other terms, unless the beam pattern is omnidirectional, the magnitude squared response has a global minimum. In order to find the global minimum, we find the derivative of the magnitude squared response with respect to θ, i.e.

$$\frac{dR(\omega,\theta)}{d\theta} = \frac{\omega d}{2c}\sin(\theta)((|\beta|^2-1)\sin A - 2\Im\beta\cos A).$$

Setting the gradient equal to zero, we see that we have zero gradient as function of θ and β when sin(θ)=0 and when $(|\beta|^2-1)\sin A-2\Im\beta\cos A=0$. The first term is fulfilled when θ=0° or θ=180°. This can be explained by the fact that the beam pattern is symmetric along the microphone array axis. Considering the second term, we can rewrite the term as $$((\Re\beta)^2 + (\Im\beta)^2 - 1) - 2\Im\beta\frac{\cos A}{\sin A} = 0$$

$$(\Re\beta - 0)^2 + (\Im\beta - \cot A)^2 = 1 + \cot^2 A$$

$$(\Re\beta - 0)^2 + (\Im\beta - \cot A)^2 = \csc^2 A$$

$$(\Re\beta - 0)^2 + \left(\Im\beta - \frac{\cos A}{\sin A}\right)^2 = \frac{1}{\sin^2 A}$$

where $\Re$ <·> denotes the real part of <·>. We recognize this equation as the equation of a circle centered in the complex plane at $$(\Re\beta, \Im\beta) = \left(0, \cot\left(\frac{\omega d}{c}(\cos\theta_0 - \cos\theta)\right)\right)$$

with the radius $$r = \left|\sec\left(\frac{\omega d}{c}(\cos\theta_0 - \cos\theta)\right)\right|.$$

For the more general case, where the direction-dependent time delay describing the difference between the microphones is expressed by $$h = \begin{bmatrix} 1 \\ \alpha e^{-j\frac{\omega d}{c}\cos\theta} \end{bmatrix},$$

the magnitude squared response R(ω) can—under certain simplifying conditions—be written as $$R(\omega,\theta) = \frac{1}{(1+\alpha^2)^2}(1+\alpha^4+2\alpha^2\cos A + |\beta|^2 2\alpha^4(1-\cos A)) - \frac{1}{(1+\alpha^2)^2}(2\Im\beta(\alpha^2-\alpha^4)(1-\cos A) - 2\Im\beta(\alpha^2+\alpha^4)\sin A),$$

In this case, the minimum value of the magnitude response is located at $$(\Re\beta, \Im\beta) = \left(\frac{(1+\alpha^2)}{2\alpha^2}, \frac{(1+\alpha^2)}{2\alpha^2\tan\frac{A}{2}}\right)$$

indicating that the minimum values as a function of A(ω,θ) are located on a line parallel to the imaginary axis.

Figure 2A:
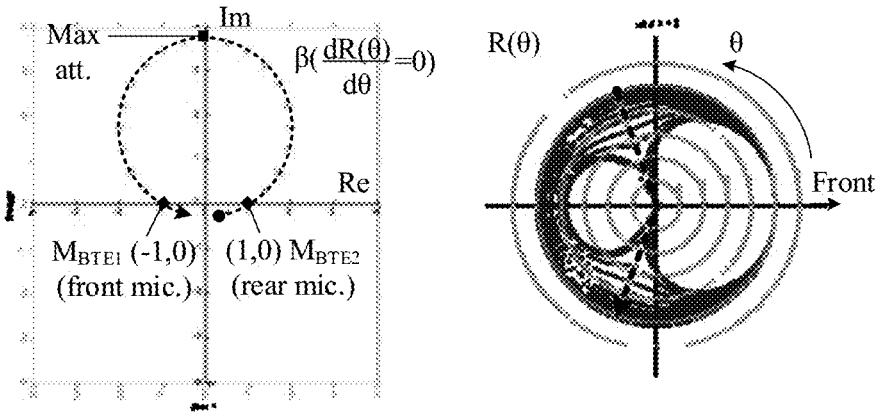
FIG. 2A shows in the right graph plots of the polar response of an adaptive beamformer filtering unit according to the present disclosure for a normalized frequency of $(\omega d/c)=\pi/8$, and zero gradient of the polar response at 110°, and in the left graph a plot of the (complex) values of $\beta_{mix}$ corresponding to the zero gradient of the polar responses of the right graphs.
Figure 2B:
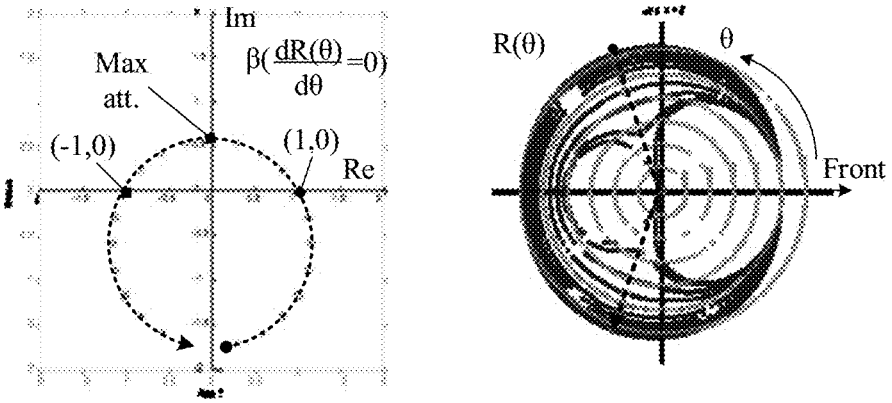
FIG. 2B shows the same as FIG. 2A, but at a normalized frequency of $(\omega d/c)=\pi/2$.
Figure 2C:
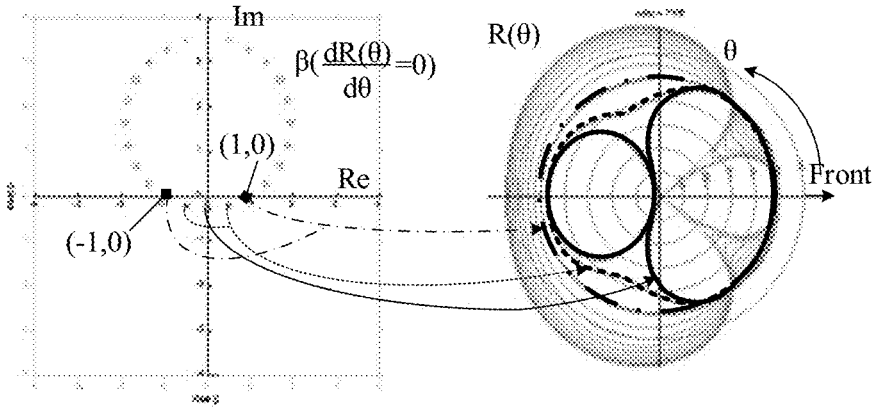
FIG. 2C shows the same as FIG. 2A, but at a normalized frequency of $(\omega d/c)=\pi/8$, FIG. 3 schematically shows an exemplary plot of the (complex) values of $\beta_{mix}$ corresponding to a zero gradient of the polar response of an adaptive beamformer filtering unit according to the present disclosure, where the resulting beam patterns for four different values of $\beta_{mix}$ between a fully adaptive ($\beta_{mix}-\beta_{opt}$) and a fixed beam pattern ($\beta_{mix}-\beta_{fix}$) are illustrated.

Examples of such circles are given in FIGS. 2A, 2B and 2C. We see that beam patterns with a magnitude squared response having zero gradient towards 110 degrees all correspond values of β distributed on a circle in a coordinate system spanned the real and imaginary part of β. We see (for (ωd/c)<π/2) that when the imaginary part is positive, the zero gradient correspond to a minimum, and when the imaginary part is negative, the response correspond to a maximum.

FIGS. 2A, 2B and 2C illustrate A) in the right graph plots of the polar response of an adaptive beamformer filtering unit for three different normalized frequencies of (ωd/c)=π/8, π/2, and 7π/8, and zero gradient of at 110°, and B) in the left graph a plot of the (complex) values of β corresponding to the zero gradient of the polar plots, i.e. β(dR(θ)/dθ=0) of the right plots, FIG. 2A shows the beam patterns for a frequency corresponding to $$\frac{\omega d}{c} = \frac{\pi}{8}$$

and FIG. 2B corresponds to a frequency corresponding to $$\frac{\omega d}{c} = \frac{\pi}{2}.$$

With d=0.01 m and $$c = 340\,\frac{m}{s},$$

FIG. 2A corresponds to a frequency of 2125 Hz and FIG. 3B corresponds to a frequency of 8500 Hz. The proposed invention mainly addresses beam patterns generated when $$\frac{\omega d}{c} \ll \pi,$$

as spatial aliasing may occur for values of β when $$\frac{\omega d}{c} > \pi.$$

The behaviour of beta, when $$\frac{\omega d}{c} > \frac{\pi}{2}$$

is shown in FIG. 2C (specifically a frequency of 14875 Hz).

Referring to FIG. 2A: In order to achieve a response with zero gradient towards a direction of 110 degrees, the values of β should be placed on a circle in the complex plane as shown in the left plot. The look direction (denoted Front in FIG. 2A, 2B, 2C) is towards 0 degrees. The circle is found for a frequency corresponding to $$\frac{\omega d}{c} = \frac{\pi}{8}.$$

Each point at the circle corresponds to a beampattern, having its maximum attenuation or maximum gain towards 110 degrees. The maximum attenuation towards 110 degrees is achieved when $$\beta = j/\tan\frac{\omega d}{2c}(\cos\theta_0 - \cos\theta) = j/\tan\frac{\pi}{16}(\cos 0 - \cos 110)$$

i.e. the point crossing the positive part of the imaginary axis (denoted Im in the drawing). As the points on the circle move away from this point, the maximum attenuation becomes smaller. The for a given direction, the circles will always cross the points (−1, 0) and (1, 0) at the real axis (denoted Re in the drawing) corresponding to the omnidirectional response of first or the second microphones, respectively. When the imaginary part becomes negative, the magnitude squared response towards 110 degrees corresponds to a maximum response rather than a minimum response. A movement of β along the circle in the left plot from the solid dot in a direction of the arrow correspond to a movement between different polar plots in the right graph from the solid dot in a direction of the dashed arrow (or vice versa). The straight dashed arrowed line in the polar plots indicates that the minima of the different polar responses are located at the same angle (110°, −110°).

FIG. 2B shows the same as FIG. 2A, but at a normalized frequency of (ωd/c)=π/2. Again, when the imaginary part is positive (left graph), a minimum gain towards 110 degrees is exhibited in the magnitude squared response (right graph).

FIG. 2C shows the same as FIG. 2A, but at a normalized frequency of (ωd/c)=7π/8. In this case $$\beta = j/\tan\frac{7}{16}(\cos 0 - \cos 110)$$

becomes negative, and the beamformer placing its null towards the 110 degrees thus correspond to a value of β located at the negative part of the imaginary axis, cf. bold face graphs in the magnitude squared response (right graph), which (by curved arrows) are associated with the corresponding β-values having negative imaginary part (left graph).

It is proposed to fade between two different beam patterns: The first beam pattern is the optimal beam pattern ($\beta_{opt}$) in terms of attenuating unwanted noise as much as possible under the constraint that sound from the look direction is unaltered. For this beam pattern, β is adaptively calculated as $$\beta_{opt} = \frac{\langle C * O \rangle}{\langle |C|^2 \rangle},$$

Figure 3:
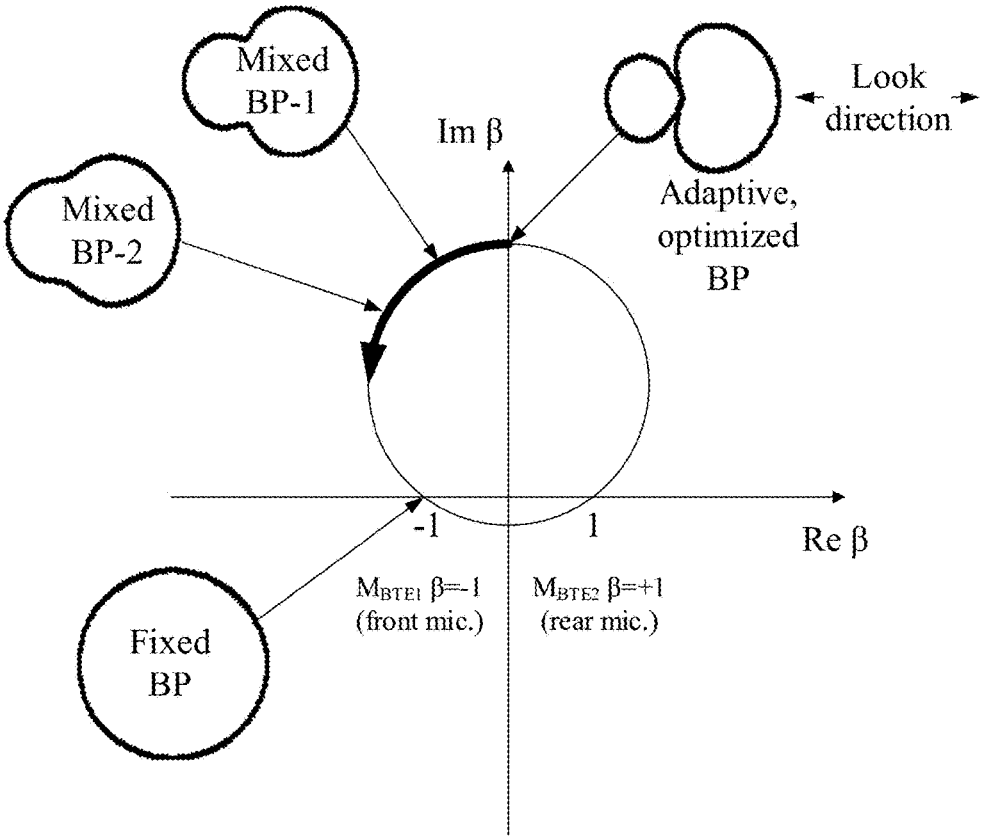

The second beam pattern is a fixed beam pattern ($\beta_{fix}$), having a desired directional shape suitable for listening to sounds from all directions. This beam pattern could have an omni-directional response or a response, which closer mimics the directional response of a human ear. FIG. 3 illustrates an example of changing β away from its optimal value ($\beta_{opt}$) towards a fixed beam pattern ($\beta_{fix}$) while the null direction is maintained. The fixed beam pattern may in general be any appropriate beam pattern, e.g. a substantially omni-directional beam pattern, such as an optimized omni-directional beam pattern, e.g. a pinna beam pattern that aims at mimicking the beam pattern of a an omni-directional microphone located at or in an ear canal of the user, cf. e.g. our co-pending European patent application EP16164350.7 titled "A hearing aid comprising a directional microphone system" filed on 8 Apr. 2016, which is incorporated herein by reference.

FIG. 3 shows an exemplary plot of the (complex) values of $\beta_{mix}$ corresponding to a zero gradient of the polar response of an adaptive beamformer filtering unit according to the present disclosure, where the resulting beam patterns for four different values of $\beta_{mix}$ between a fully adaptive ($\beta_{mix}=\beta_{opt}$) and a fixed beam pattern ($\beta_{mix}=\beta_{fix}$) are illustrated.

FIG. 3 illustrates an embodiment of scheme for constraining an adaptive beamformer according to the present disclosure. For the adaptive beamformer the value of β ($\beta_{opt}$), which aims at minimizing the noise under the constraint that the look direction is essentially unaltered, is determined (cf. top right schematic beam pattern denoted Adaptive, optimized BP). By changing β along the circle as indicated by the bold arrow, the effect of the (resulting) beamformer can be reduced while maintaining its maximum effect towards the same direction of which the original beamformer has adapted its null (cf. two top left schematic beam patterns denoted Mixed BP-1 and Mixed BP-2, respectively). The omnidirectional front microphone ($M_1$) response is reached when β=−1. Similar beampatterns would be achieved by changing beampattern clockwise. In that case, we would reach the omnidirectional beampattern corresponding to the rear microphone ($M_2$), when β=1. If the front microphone is chosen as the reference microphone, it is advantageous to modify β by moving along the circle in the counter-clockwise direction (and vice versa).

In general, the fixed beam pattern most likely does not contain its maximum attenuation towards the same direction as the maximum attenuation of the adaptive beam pattern. In that case the maximum attenuation towards a given direction cannot be maintained while fading. Such examples are shown in FIG. 4A-4F. The fading curves are described as ideal smooth curves, e.g. lines or sections of a circle. In practice, they may be implemented as approximations, e.g. as piece-wise linear curves.

Figure 4A:
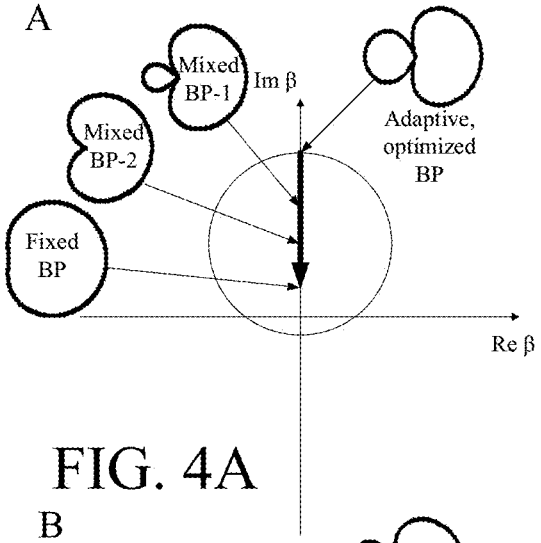
FIG. 4A shows an exemplary plot of the (complex) values of $\beta_{mix}$ and corresponding exemplary beam patterns (as in FIG. 3) representing a first scheme for modifying (fading) the beam pattern of an adaptive beamformer filtering unit according to the present disclosure between a fully adaptive ($\beta_{mix}-\beta_{opt}$) and a fixed beam pattern ($\beta_{mix}=\beta_{fix}$)
Figure 4B:
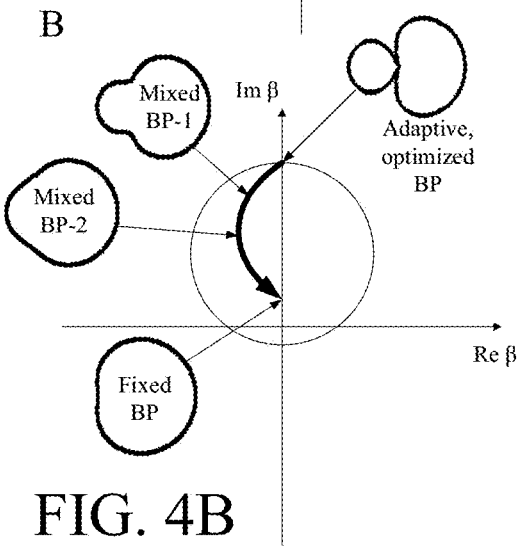
FIG. 4B shows the same as FIG. 4A, but illustrating a second scheme for modifying (fading) the beam pattern.
Figure 4C:
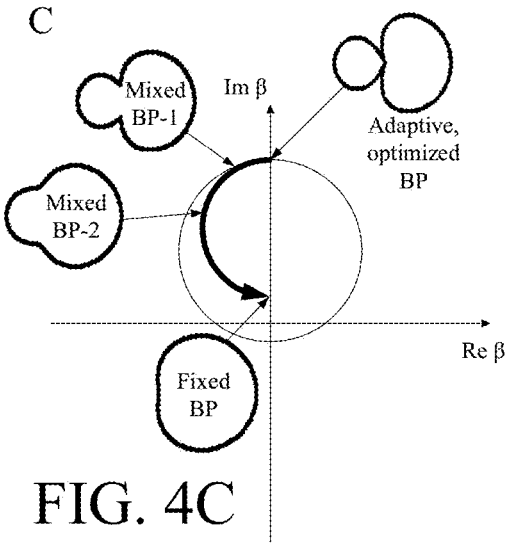
FIG. 4C shows the same as FIG. 4A, but illustrating a third scheme for modifying (fading) the beam pattern.

FIGS. 4A, 4B 4C, 4D, 4E, and 4F illustrate six different ways of fading between two beam patterns. FIG. 4A shows an exemplary plot of the (complex) values of β and corresponding exemplary beam patterns (as in FIG. 3) representing a first scheme for modifying (fading) the beam pattern of an adaptive beamformer filtering unit according to the present disclosure between a fully adaptive ($\beta=\beta_{opt}$) and a fixed beam pattern ($\beta=\beta_{fix}$). FIG. 4B shows the same as FIG. 4A, but illustrating a second scheme for modifying (fading) the beam pattern, and FIG. 4C shows the same as FIG. 4A, but illustrating a third scheme for modifying (fading) the beam pattern. In all cases the intention is to select a beam pattern which is between the optimal (adaptive) beam pattern in terms of reducing the noise, and a second (fixed) beam pattern which is better at maintaining sounds impinging from all directions. In the example above, $\beta=\beta_{fix}$ representing the fixed beam pattern (Fixed BP) is located on the imaginary axis (Im $\beta$). FIG. 4A (A) shows how the beam patterns change if we select a beam pattern ($\beta$) by moving along a straight line (bold straight line arrow). In that case, the beam pattern is adapted by moving the null direction away from the look direction until the fixed beam pattern is achieved. The null moves towards 180 degrees. After 180 degrees is reached, the null depth becomes smaller. FIGS. 4B (B) and 4C (C) show how the beam patterns change if we instead fade towards the fixed beam pattern along a circle (C) or something in between a straight line and a circle (B). In that case we can better avoid placing a null towards any direction, and better maintain the maximum attenuation towards the direction to which the adaptive beamformer applied its maximum attenuation.

The figures show examples on different ways of selecting a beam pattern lying between the adaptive and the fixed directional pattern. FIG. 4A illustrates a fading between the two patterns by changing the values of $\beta$ along a straight line. The resulting beam pattern in terms of $\beta$ is simply achieved by applying a weighted sum between the adaptive, optimal $\beta$, $\beta_{opt}$ and the fixed beam pattern described by $\beta_{fix}$, i.e.

$$\beta=\alpha\beta_{opt}+(1-\alpha)\beta_{fix},$$

where $\alpha$ is a weight between 0 and 1. This weight could be a fixed value or it could be adaptively controlled depending on e.g. input level, estimated signal-to-noise ratio, a voice activity detector, own voice, target-to-jammer ratio or other environmental detectors. The weight could also depend on an estimate on the user's fatigue, e.g. depending on an estimate of the amount of sound exposed to the user during the day. This way of mixing between the two beam patterns has the advantage that we do not have to actually calculate the two beam patterns as the resulting beam pattern is achieved solely by a modification of the control parameter $\beta$. By moving along a straight line, the adaptive beam pattern is moving away from its optimum. However, when fading along the imaginary axis, we just move the null direction. Hereby sounds from all directions may not be audible. This scheme may add a coloration of sound as some frequency bands are broader than other and because $\beta$ affects different widths of bands differently.

Figure 11:
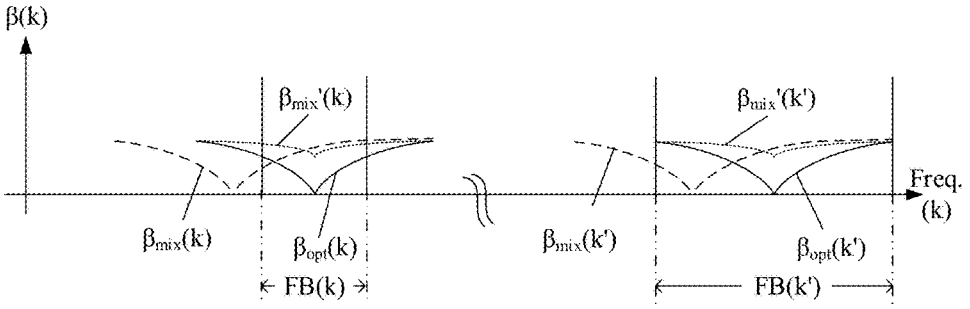
FIG. 11 shows modification of β in a narrow frequency channel k compared to a broader frequency channel k' for a frequency response of a noise source imping from a single direction (related to FIG. 4A-4F).

FIG. 11 illustrates the issue of modification of $\beta$ in a narrow frequency channel k (denoted FB(k) in FIG. 11) compared to a broader frequency channel k' (denoted FB(k') in FIG. 11). The figure shows the frequency response of a noise source impinging from a single direction. In the narrow channel, FB(k), we may change $\beta$ from $\beta_{opt}$ to $\beta_{mix}$ along the imaginary axis. Hereby we quite fast move the null outside the frequency channel and we obtain the desired effect that the beamformer attenuates less noise. Alternatively, we may change $\beta$ ($\beta_{mix}'$) along the circle and reduce the effect of the beamformer to reduce noise while maintaining the null towards the same direction (and frequency). If we look at the effect of modifying $\beta$ in a broader frequency channel, FB(k'), we see that modifying $\beta$ along the imaginary axis simply moved the null along the frequency axis within the band. The effect of modifying $\beta$ along the frequency axis will thus be smaller. The resulting response of modifying $\beta$ will thus be higher in narrow frequency channels compared to broad frequency channels. This will be perceived as a coloration of the noise source. Again, modifying $\beta$ along the circle ($\beta_{mix}'$) would, however, more effectively reduce the effect of the beamformer.

Alternatively, in order to maintain the attenuation closer to the original direction of attenuation, $\beta$ could move along a circle as shown in FIG. 4C (and in FIG. 3) in this case, the circle is centred at $$\frac{\beta_{opt}+\beta_{fix}}{2}$$

and it has a radius of $$\frac{|\beta_{opt}-\beta_{fixed}|}{2}.$$

Thus, depending on the direction of movement around the circle, either $$\beta=\frac{|\beta_{opt}-\beta_{fix}|}{2}(\cos(\pi\alpha+\angle(\beta_{opt}-\beta_{fix}))+j\sin(\pi\alpha+\angle(\beta_{opt}-\beta_{fix})))+\frac{\beta_{opt}+\beta_{fix}}{2},$$

or $$\beta=\frac{|\beta_{opt}-\beta_{fixed}|}{2}(\cos(\pi\alpha+\angle(\beta_{fixed}-\beta_{opt}))+j\sin(\pi\alpha+\angle(\beta_{fixed}-\beta_{opt})))+\frac{\beta_{opt}-\beta_{fixed}}{2},$$

where $\alpha$ is a weight between 0 and 1 as defined above. As illustrated in FIG. 4B, also other fading paths are possible.

In an embodiment, $\beta$ is normalized, e.g. in order to better interpret $\beta$ across frequency, e.g. to get more similar ranges of $\beta$. Such normalization may be defined in any appropriate way. In a specific embodiment, $\beta$ is normalized such that the null at 180 degrees correspond to 1. We thus define $\beta'=\beta/\beta_{180}$, and the corresponding weight $w_c'=w_c*\beta_{180}$.

In an embodiment, $\beta$ is normalized by a complex-valued constant. Such a normalization will also affect the formula above as a normalization would apply a 90° phase shift and a different scaling of the complex plane.

In FIG. 3 and in FIG. 4C, a modification of $\beta$ along a circle in a counter-clockwise direction is indicated. By moving in the clockwise direction, similar directional patterns are obtained. However, in that case, the circle passes through the point corresponding to the second (rear) microphone ($M_2$), i.e. $\beta=1$. In case, the first microphone ($M_1$) has been defined as the reference microphone, it is preferable to move along the circle in the direction towards $\beta=-1$ corresponding to the first microphone.

When $$\frac{\omega d}{c}>\frac{\pi}{2}$$

we may see that our optimal β has a negative imaginary part as $$\beta = \frac{j}{\tan\frac{A}{2}}$$

and $$\tan\frac{\pi^{+}}{2} < 0.$$

In that case, we have to fade in the clockwise direction in order to fade towards the first microphone at β=−1.

Figure 4D:
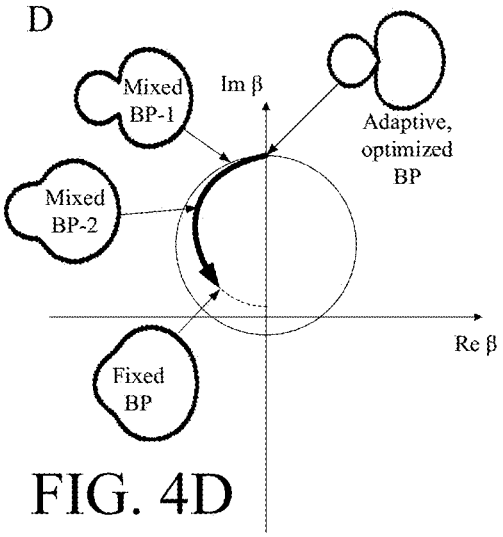
FIG. 4D shows the same as FIG. 4A, but illustrating a fourth scheme for modifying (fading) the beam pattern.

FIG. 4D shows an example where $\beta_{fix}$ is not located on the imaginary axis. In that case, the fading from $\beta_{opt}$ to $\beta_{fix}$ may be as shown along the bold curved path.

Figure 4E:
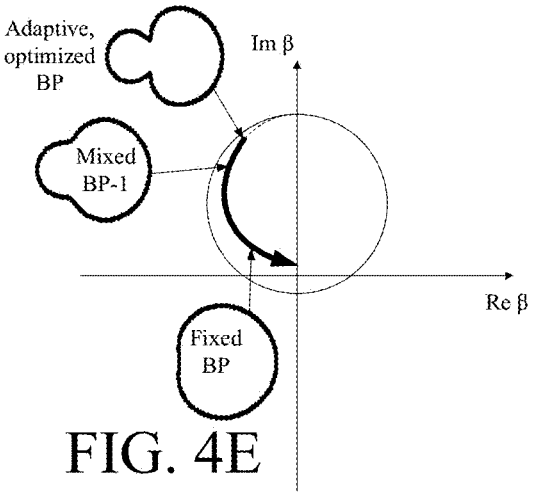
FIG. 4E shows the same as FIG. 4A, but illustrating a fifth scheme for modifying (fading) the beam pattern.
Figure 4F:
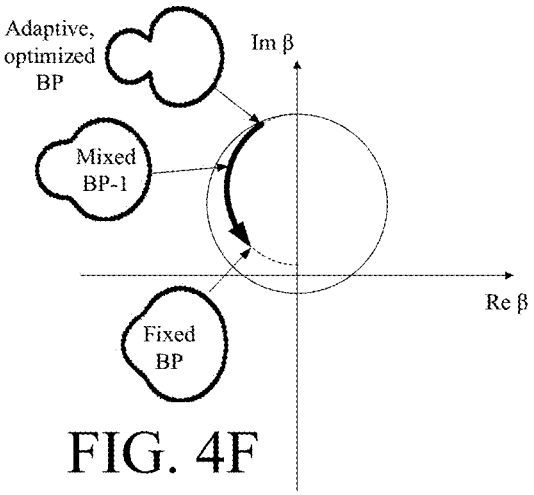
FIG. 4F shows the same as FIG. 4A, but illustrating a sixth scheme for modifying (fading) the beam pattern.

In some cases, the optimal value of β may not be located along the imaginary axis. This is e.g. the case for near field sounds. In that case, the fading between $\beta_{opt}$ and $\beta_{fix}$ may be along the circles as shown in FIG. 4E or in FIG. 4F where both $\beta_{opt}$ and $\beta_{fix}$ are not located at the imaginary axis. But also other fading paths may be used. Notice though that the shown beam patterns in FIG. 4E, 4F still correspond to far field directivity patterns.

Figure 5A:
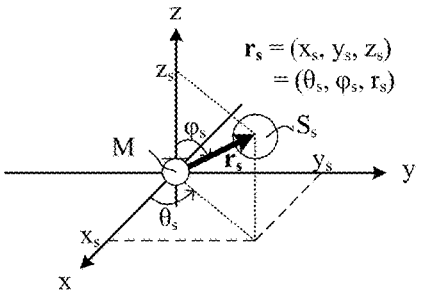
FIG. 5A shows a geometrical setup for a listening situation, illustrating a microphone of a hearing aid located at the centre (0, 0, 0) of a spherical coordinate system with a sound source located at ($\theta$, $\varphi$, r)

FIG. 5A shows a geometrical setup for a listening situation, illustrating a microphone (M) of a hearing aid located at the centre (0, 0, 0) of a coordinate system (x, y, z) or (θ, φ, r) with a sound source $S_s$ located at ($x_s$, $y_s$, $z_s$) or ($\theta_s$, $\varphi_s$, $r_s$). FIG. 5A defines coordinates of a spherical coordinate system (θ, φ, r) in an orthogonal coordinate system (x, y, z). A given point in three dimensional space, here illustrated by a location of sound source $S_s$, is represented by a vector $r_s$ from the center of the coordinate system (0, 0, 0) to the location ($x_s$, $y_s$, $z_s$) of the sound source $S_s$ in the orthogonal coordinate system. The same point is represented by spherical coordinates ($\theta_s$, $\varphi_s$, $r_s$) where $r_s$ is the radial distance to the sound source $S_s$, $\varphi_s$ is the (polar) angle from the z-axis of the orthogonal coordinate system (x, y, z) to the vector $r_s$, and $\theta_s$, is the (azimuth) angle from the x-axis to a projection of the vector $r_s$ in the xy-plane (z=0) of the orthogonal coordinate system.

Figure 5B:
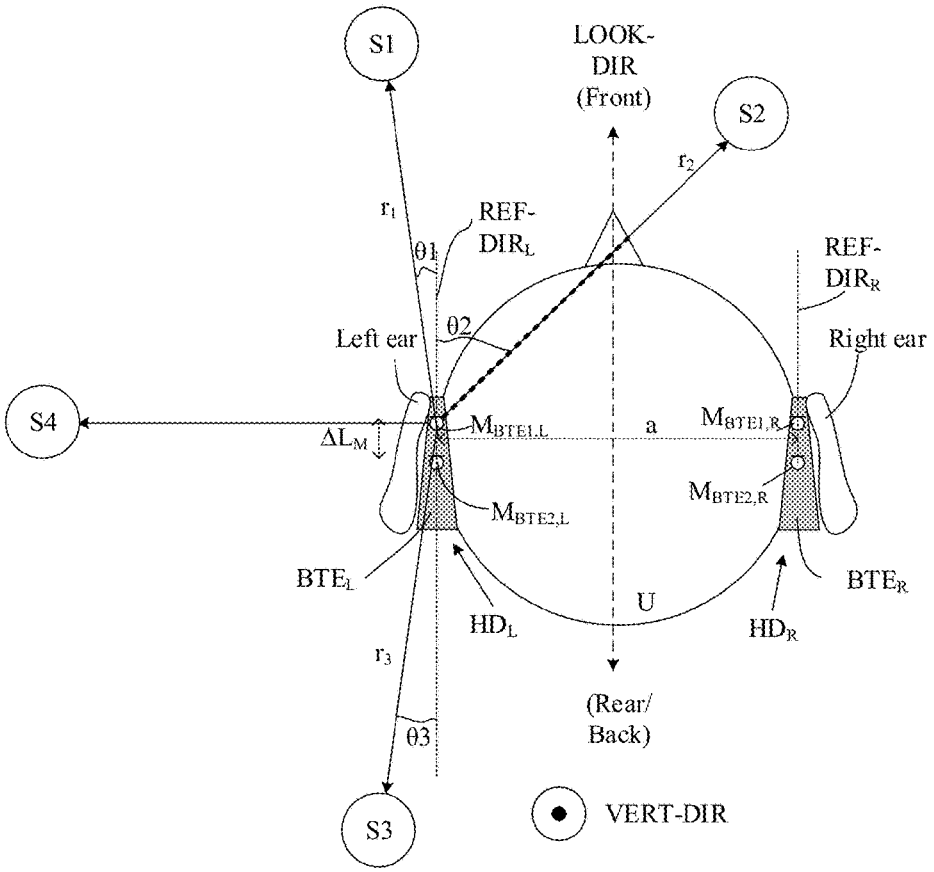
FIG. 5B shows a hearing aid user wearing left and right hearing aids in a listening situation comprising different sound sources located at different points in space relative to the user.

FIG. 5B shows a hearing aid user (U) wearing left and right hearing aids ($HD_L$, $HD_R$) (forming a binaural hearing aid system) in a listening situation comprising different sound sources ($S_1$, $S_2$, $S_3$) located at different points in space ($\theta_s$, $r_s$, ($\varphi_s$=$\varphi_0$), s=1, 2, 3, 4) relative to the user (or the same sound source S located at different positions (1, 2, 3, 4)). Each of the left and right hearing aids ($HD_L$, $HD_R$) comprises a part, termed a BTE-part (BTE). Each BTE-part ($BTE_L$, $BTE_R$) is adapted for being located behind an ear (Left ear, Right ear) of the user (U). A BTE-part comprises first ('Front') and second ('Rear') microphones ($M_{BTE1,L}$, $M_{BTE2,L}$; $M_{BTE1,R}$, $M_{BTE2,R}$) for converting an input sound to first $IN_1$ and second $IN_2$ electric input signals (cf. e.g. FIG. 9A, 9B), respectively.

The microphones in the hearing aids of FIG. 5B are denoted $M_{BTE1}$, $M_{BTE2}$, instead of $M_1$, $M_2$ to specifically indicate their location on a BTE-part of the respective hearing aids. The same is true for the microphones of the hearing aid shown in FIG. 8. In other drawings, microphones are denoted M1, M2, . . . , to indicate that they are NOT (necessarily) located in a BTE-part, but may be located in an ITE-part or elsewhere on the head or body of the user.

The first and second microphones ($M_{BTE1}$, $M_{BTE2}$) of a given BTE-part, when located behind the relevant ear of the user (U), are characterized by transfer functions $H_{BTE1}$(θ, φ, r, k) and $H_{BTE2}$(θ, φ, r, k) representative of propagation of sound from a sound source S located at (θ, φ, r) around the BTE-part to the first and second microphones of the hearing aid ($HD_L$, $HD_R$) in question, where k is a frequency index. In the setup of FIG. 5B, the target signal is assumed to be in the frontal direction relative to the user (U) (cf. e.g. LOOK-DIR (Front) in FIG. 5B), i.e., (roughly) in the direction of the nose of the user, and of a microphone axis of the BTE-parts (cf. e.g. reference directions REF-$DIR_L$, REF-$DIR_R$, of the left and right BTE-parts ($BTE_L$, $BTE_R$) in FIG. 5B). The sound source(s) ($S_1$, $S_2$, $S_3$, $S_4$) are located around the user as defined by spatial coordinates, here spherical coordinates ($\theta_s$, $\varphi_s$, $r_s$), s=1, 2, 3, 4, defined relative to the reference directions REF-$DIR_L$ for the left hearing aid ($HD_L$) (and correspondingly to REF-$DIR_R$ for the right hearing aid, $HD_R$).

The sound source(s) ($S_1$, $S_2$, $S_3$, $S_3$) may schematically illustrate a measurement of transfer functions of sound from all relevant directions (defined by azimuth angle $\theta_s$) and distances ($r_s$) around the user (U). The directions for the left hearing aid $HD_L$ to the sound sources $S_s$ are indicated in FIG. 1B by solid arrows denoted $r_s$, s=1, 2, 3, 4, and correspondingly by angles θs, s=1, 2, 3, 4, relative to the microphone axis (REF-$DIR_L$). The first and second microphones of a given BTE-part are located at predefined distance $\Delta L_M$ apart (often referred to as microphone distance d, e.g. between 7 mm and 12 mm). The two BTE-parts ($BTE_L$, $BTE_R$) and thus the respective microphones of the left and right BTE-parts, are located a distance a apart (e.g. between 100 mm and 250 mm), when mounted on the user's head in an operational mode. The view in FIG. 1B is a planar view in a horizontal plane through the microphones of the first and second hearing aids (perpendicular to a vertical direction, indicated by out-of-plane arrow VERT-DIR in FIG. 5B) and corresponding to plane z=0 (φ=90°) in FIG. 5A. In a simplified model, it is assumed that the sound sources ($S_i$) are located in a horizontal plane (e.g. the one shown in FIG. 5B). Front and rear directions relative to the user are defined in FIG. 5B (cf. LOOK-DIR (Front) and (Rear/Back), respectively)

Figure 6A:
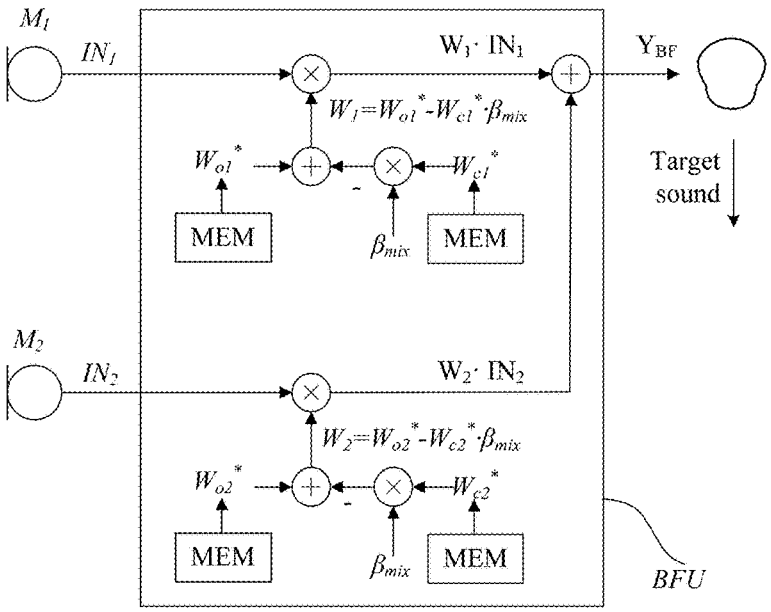
FIG. 6A shows a first embodiment of an adaptive beamformer filtering unit according to the present disclosure.
Figure 9A:
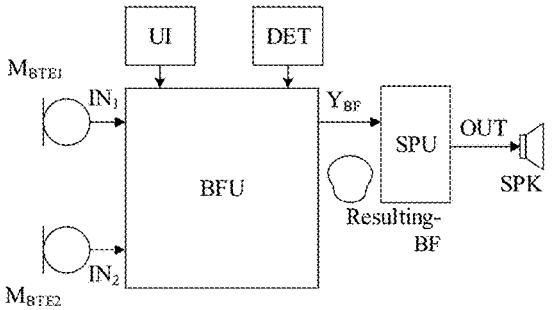
FIG. 9A shows a block diagram of a first embodiment of a hearing aid according to the present disclosure.
Figure 9B:
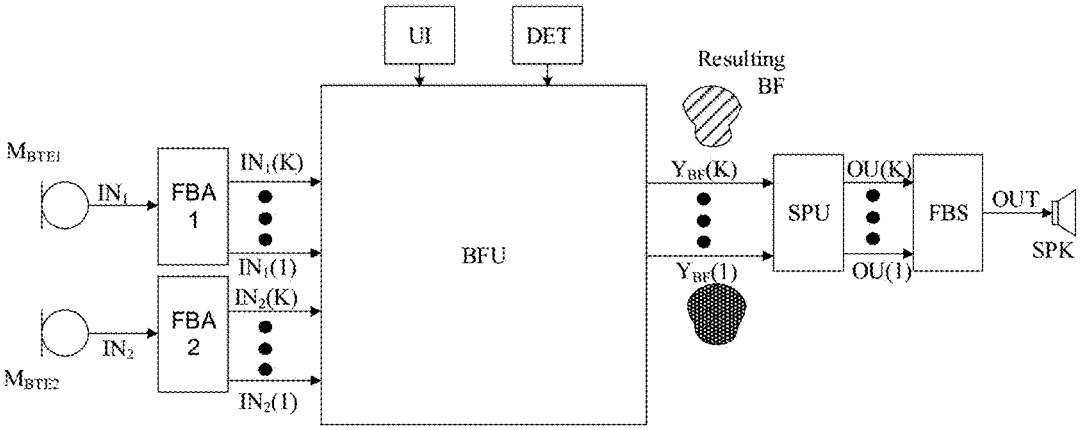
FIG. 9B shows a block diagram of a second embodiment of a hearing aid according to the present disclosure.

FIG. 6A shows a first embodiment of an adaptive beamformer filtering unit (BFU) according to the present disclosure. FIG. 6A shows a block diagram of an exemplary two-microphone beamformer configuration for use in a hearing aid according to the present disclosure (e.g. as shown in FIG. 9A, 9B). A direction from the target signal to the hearing aid is e.g. defined by the microphone axis and indicated in FIGS. 6A (and 6B, 6D and 6E) by arrow denoted Target sound. The beamformer configuration of FIG. 6A comprises first and second microphones ($M_1$, $M_2$) for converting an input sound to first $IN_1$ and second $IN_2$ electric input signals, respectively. The beamformer unit (BFU) comprises a first memory comprising a first set of complex frequency dependent weighting parameters $W_{o1}$(k), $W_{o2}$(k) representing a first beam pattern (O), where k is a frequency index, k=1, 2, . . . , K, and a second memory comprising a second set of complex frequency dependent weighting parameters $W_{c1}$(k), $W_{c2}$(k) representing a second beam pattern (C). The first and second memory may be implemented as one memory unit. The first and second sets of weighting parameters $W_{o1}$(k), $W_{o2}$(k) and $W_{c1}$(k), $W_{c2}$(k), respectively, are predetermined and possibly updated during operation of the hearing aid. The first beam pattern may represent a delay and sum beamformer O providing (at relatively low frequencies, e.g. below 1.5 kHz) an omni-directional beam pattern. The second beam pattern may represent a delay and subtract beamformer C providing a target-cancelling beam pattern.

$$O=O(k)=W_{o1}(k)^*\cdot IN_1+W_{o2}(k)^*\cdot IN_2,$$

$$C=C(k)=W_{c1}(k)^*\cdot IN_1+W_{c2}(k)^*\cdot IN_2.$$

In the exemplary embodiment of FIG. 6A, the resulting beamformed signal $Y_{BF}$ is a weighted combination of the first and second electric input signals $IN_1$, $IN_2$:

$$Y_{BF}=Y_{BF}(k)=W_1(k)\cdot IN_1+W_2(k)\cdot IN_2,$$

$$Y_{BF}=Y_{BF}(k)=(W_{o1}(k)^*-\beta_{mix}W_{c1}(k)^*)\cdot IN_1+(W_{o2}(k)^*-\beta_{mix}W_{c2}(k)^*)\cdot IN_2,$$

The beamformer filtering unit (BFU) may be implemented in the time domain or in the time-frequency domain (appropriate filter banks being implied, e.g. inserted after the first and second microphones, cf. e.g. FIG. 9B). $\beta_{mix}(k)$ is a frequency dependent parameter controlling the final shape of the directional beam pattern (of signal $Y_{BF}$) of the beamformer filtering unit (BFU). In an embodiment, the resulting complex, frequency dependent adaptation parameter $\beta_{mix}(k)$ is a combination of a fixed frequency dependent adaptation parameter $\beta_{fix}(k)$ and an adaptively determined frequency dependent adaptation parameter $\beta_{opt}(k)$. The complex weighting parameter sets ($W_{o1}(k)$, $W_{o2}(k)$), ($W_{c1}(k)$, $W_{c2}(k)$), and $\beta_{fix}(k)$ are preferably stored in the memory unit MEM of the beamformer unit (BFU) or elsewhere in the hearing aid (e.g. implemented in firmware of hardware). The complex weighting parameter sets ($W_{o1}(k)$, $W_{o2}(k)$), ($W_{c1}(k)$, $W_{c2}(k)$) may e.g. be predetermined, e.g. measured using a model of a human head (e.g. HATS, Head and Torso Simulator 4128C from Brüel & Kjær Sound & Vibration Measurement A/S), whereon hearing aid(s) according to the present disclosure is(are) mounted at a left and/or right ear, or estimated using a simulation model, or measured on the user. The complex weighting parameter sets ($W_{o1}(k)$, $W_{o2}(k)$), ($W_{c1}(k)$, $W_{c2}(k)$) may e.g. be updated during use of the hearing aid, e.g. adaptively updated in dependence of a current target direction (or other parameters from one or more detectors, e.g. regarding the current acoustic environment).

Figure 6B:
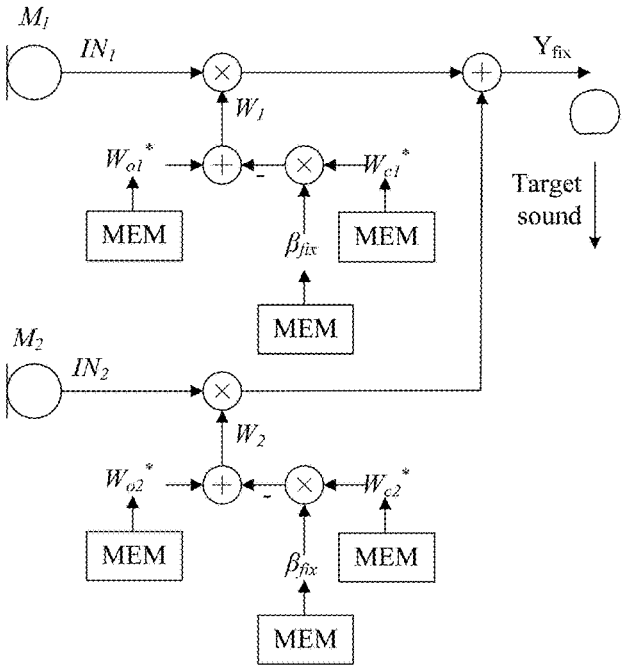
FIG. 6B shows an embodiment of a fixed beamformer of an adaptive beamformer filtering unit according to the present disclosure.

FIG. 6B shows a block diagram of the exemplary two-microphone fixed beamformer configuration. By insertion of the complex constants in the logic diagram of FIG. 6B, and re-arranging the elements, the following expression for $Y_{fix}$ appears:

$$Y_{fix}(k)=(W_{o1}(k)^*-\beta_{fix}(k)\cdot W_{c1}(k)^*)\cdot IN_1+(W_{o2}(k)^*-\beta_{fix}(k)\cdot W_{c2}(k)^*)\cdot IN_2.$$

The fixed beamformer may be implemented by optimized complex constants $W_1(k)=W_{o1}(k)^*-\beta_{fix}(k)\cdot W_{c1}(k)^*$ and $W_2(k)=W_{o2}(k)^*-\beta_{fix}(k)\cdot W_{c2}(k)^*$ stored in memory unit (MEM). In an embodiment, the optimized fixed frequency dependent adaptation parameter $\beta_{fix}(k)$ represents an omni-directional beam pattern, e.g. optimized to minimize a difference to a characteristic of an ideally located microphone at or in the ear canal, e.g. determined as described in our co-pending European patent application titled "A hearing aid comprising a directional microphone system" referenced above.

Figure 6C:
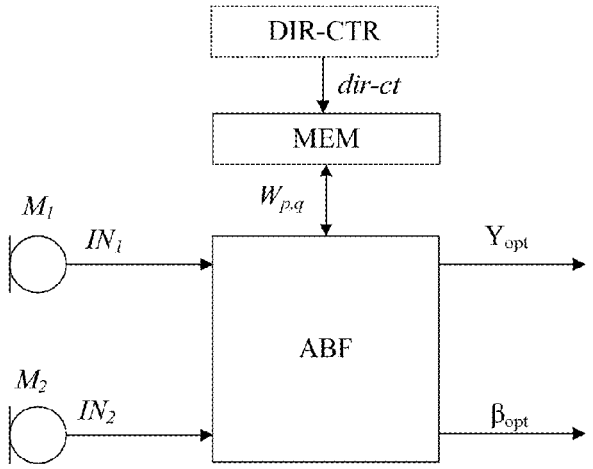
FIG. 6C shows an embodiment of an adaptive beamformer of an adaptive beamformer filtering unit according to the present disclosure.

FIG. 6C shows an embodiment of an adaptive beamformer (ABF) of an adaptive beamformer filtering unit (BFU) according to the present disclosure. The adaptive beamformer provides an adaptively beamformed signal $Y_{opt}$ and adaptively determined frequency dependent adaptation parameter $\beta_{opt}(k)$ based on electric inputs signals $IN_1$ and $IN_2$ and a number of complex weighting parameters $W_{p,q}$, e.g. complex weighting parameter sets ($W_{o1}(k)$, $W_{o2}(k)$) and ($W_{c1}(k)$, $W_{c2}(k)$) (and possibly information regarding a target direction, e.g. a 'look vector', if deviating from a predefined (reference) target direction) stored in memory unit MEM. The complex weighting parameters $W_{p,q}$, may be predetermined (prior to normal operation, e.g. stored during manufacturing or fitting, of the hearing aid) and/or dynamically updated controlled by control unit DIR-CTR (dotted outline) and control signal dir-ct. The adaptive beamformer (ABF) may e.g. be implemented as a generalized sidelobe canceller (GSC), e.g. as an MVDR beamformer, as e.g. described in EP2701145A1.

Figure 6D:
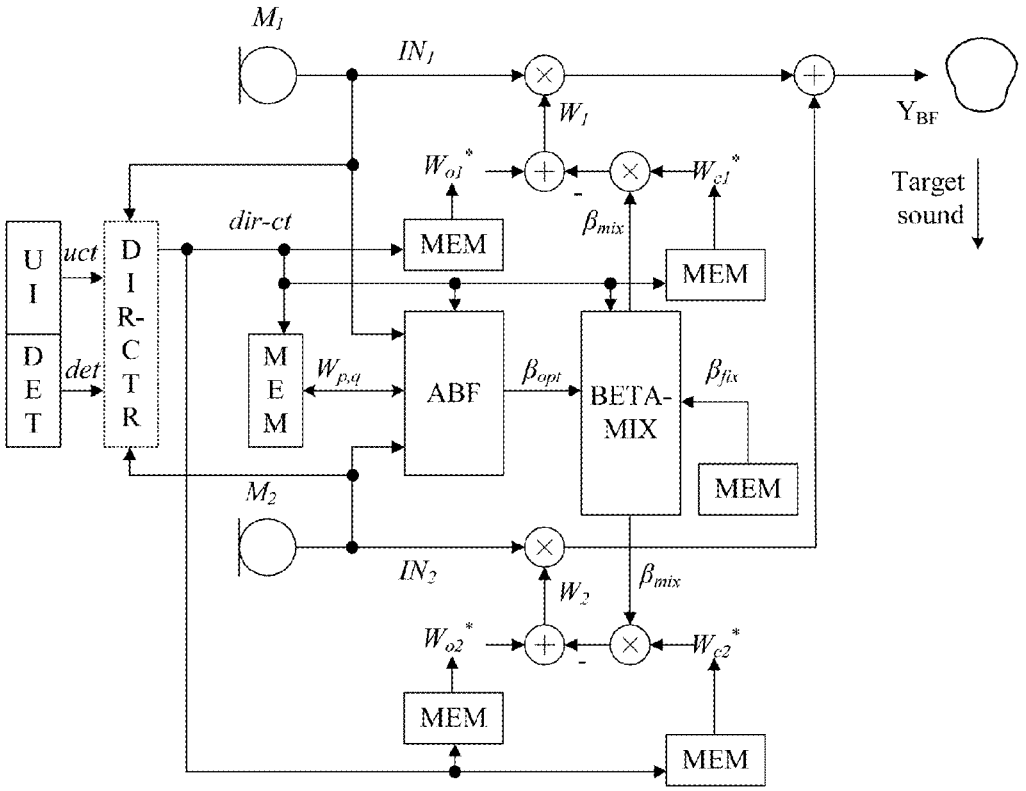
FIG. 6D shows a second embodiment of an adaptive beamformer filtering unit according to the present disclosure.

FIG. 6D shows a second embodiment of an adaptive beamformer filtering unit according to the present disclosure. The embodiment of FIG. 6D comprises the embodiment of FIG. 6A and additionally comprises units for providing the frequency dependent adaptation parameter $\beta_{mix}(k)$. The (second) embodiment of FIG. 6D comprises an adaptive beamformer (ABF) for providing an adaptively determined optimized beam pattern $\beta_{opt}(k)$ as discussed in connection with FIG. 6C and a mixing unit (BETA-MIX) for providing a modified beam pattern comprising a mixture of the adaptively determined beam pattern $\beta_{opt}(k)$ and the fixed beam pattern $\beta_{fix}(k)$ (as discussed in connection with FIG. 6B). A memory (MEM) comprises complex weighting parameters ($W_{o1}(k)$, $W_{o2}(k)$) and ($W_{c1}(k)$, $W_{c2}(k)$, or their complex conjugate) representing an (at least at relatively low frequencies) omni-directional and a target cancelling beam pattern, respectively, and adaptation parameter $\beta_{fix}$. The memory (MEM) further comprises complex weighting parameters $W_{p,q}$ (e.g. equal to ($W_{o1}(k)$, $W_{o2}(k)$) and ($W_{c1}(k)$, $W_{c2}(k)$) or their complex conjugate) used by the adaptive beamformer (ABF). The embodiment of FIG. 6D further comprises one or more detectors (DET) of the current acoustic environment and/or of the user's present physical state or mental state (e.g. cognitive or acoustic load). The one or more detectors (DET) provides corresponding detector output signal det which is fed to a control unit (DIR-CTR) for controlling or influencing the adaptive beamformer filtering unit (BFU). The embodiment of FIG. 6D further comprises a user interface (UI) (e.g. implemented in a remote control, e.g. a smartphone, see e.g. FIG. 8). The user interface (UI) allows a user to influence the directional system (e.g. the beamformer filtering unit (BFU)), e.g. a direction from the user to the target sound source. The user interface provides control signal uct to the directionality control unit (DIR-CTR). The directionality control unit (DIR-CTR) is (via signal(s) dir-ct) operationally coupled to the memory unit (MEM) holding predefined complex weighting parameters, so that these parameters can be adaptively updated (which requires an update of the complex weighting constants $W_{oi}$, $W_{ci}$), e.g. if a target direction is modified, and/or according to a change in the current acoustic environment. The electric input signals $IN_1$, $IN_2$ are coupled to the directionality control unit (DIR-CTR) to allow an evaluation of characteristics of the current acoustic environment that materializes in the microphone signals (e.g. to extract properties, such as input level, modulation, reverberation, wind noise, speech, no-speech, etc.), as a supplement to possible other detectors (DET), which may be external to the hearing aid (e.g. forming part of a smart phone or the like) or internal in the hearing aid.

Figure 6E:
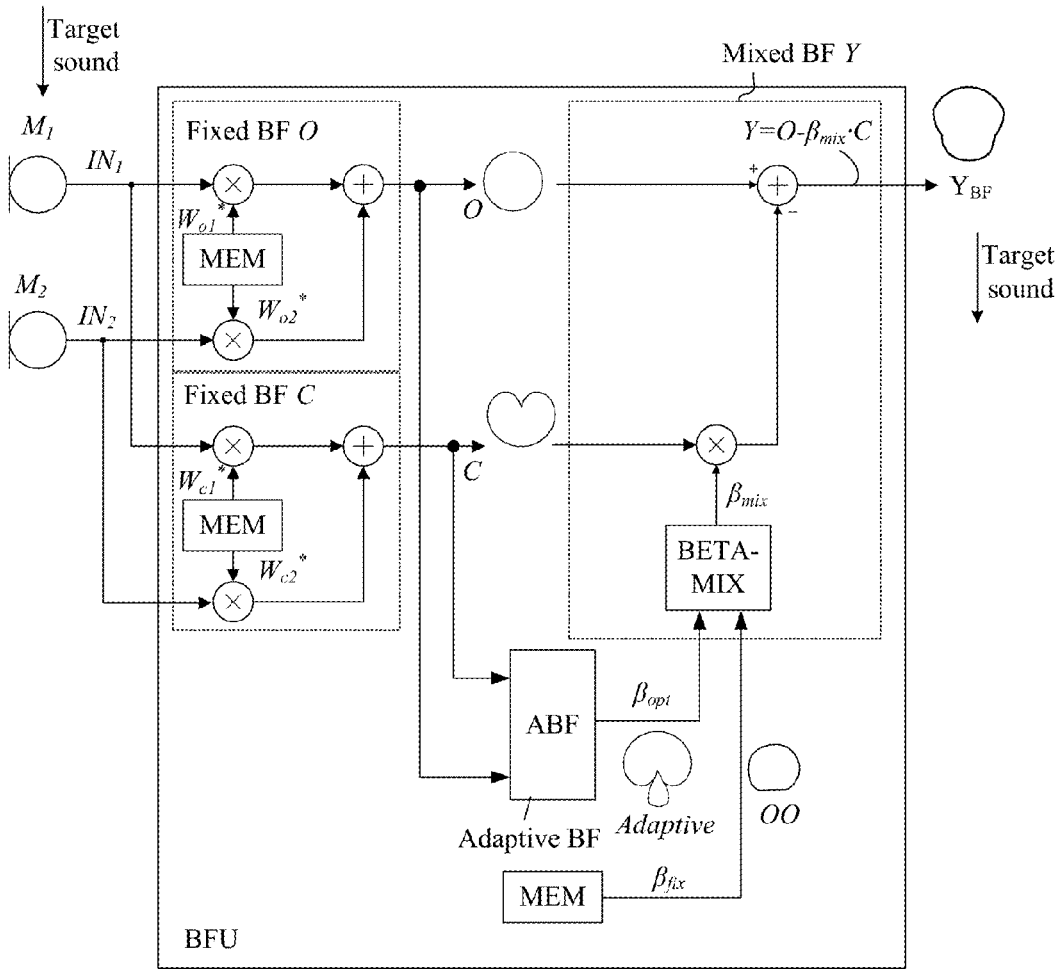
FIG. 6E shows a third embodiment of an adaptive beamformer filtering unit according to the present disclosure.

FIG. 6E shows a third embodiment of an adaptive beamformer filtering unit (BFU) according to the present disclosure. The beamformer unit comprises first (omni-directional) and second (target cancelling) beamformers (denoted Fixed BF O and Fixed BF C in FIG. 6E. The first and second beamformers provide beamformed signals O and C, respectively, as linear combinations of first and second electric input signals IN1 and IN2, where first and second sets of complex weighting constants ($W_{o1}(k)$, $W_{o2}(k)$) and ($W_{c1}(k)$, $W_{c2}(k)$) representative of the respective beam patterns are stored in memory unit (MEM). The adaptive beamformer filtering unit (BFU) further comprises an adaptive beamformer (Adaptive BF, ABF) providing adaptation constant $\beta_{opt}(k)$ representative of an (optimized) adaptively determined beam pattern. The memory unit (MEM) further comprises adaptation constant $\beta_{fix}(k)$ representing a fixed (e.g. optimized) omni-directional beam pattern (OO). The adaptive beamformer filtering unit (BFU) further comprises mixing unit (BETA-MIX) for providing the resulting complex, frequency dependent adaptation parameter $\beta_{mix}(k)$ as a combination of the fixed frequency dependent adaptation parameter $\beta_{fix}(k)$ and the adaptively determined frequency dependent adaptation parameter $\beta_{opt}(k)$. In other words $\beta_{mix}(k)=f(\beta_{opt}(k), \beta_{fix}(k))$, where $f(\cdot)$ represents a functional dependence of the adaptation parameters $\beta_{opt}(k)$ and $\beta_{fix}(k)$. The resulting adaptation parameter $\beta_{mix}(k)$ is multiplied onto the beamformed signal C and subtracted from the beamformed signal O (by respective combination units) to provide the resulting beamformed signal, $Y_{BF}$ (which may be presented to a user as stimuli perceived as an acoustic signal directly or subject to further processing before presentation to the user). The resulting beamformed signal can thus be expressed as $$Y_{BF}(k)=O(k)-\beta_{mix}(k)\cdot C(k)$$

$$Y_{BF}(k)=(W_{o1}^{*}\cdot IN_1+W_{o2}^{*}\cdot IN_2)-\beta_{mix}(k)\cdot(W_{c1}^{*}\cdot IN_1+W_{c2}^{*}\cdot IN_2)$$

$$Y_{BF}(k)=(W_{o1}^{*}\cdot IN_1+W_{o2}^{*}\cdot IN_2)-f(\beta_{opt}(k),\beta_{fix}(k))\cdot(W_{c1}^{*}\cdot IN_1+W_{c2}^{*}\cdot IN_2)$$

It may be computationally advantageous just to calculate the actual resulting weights applied to each microphone signal rather than calculating the different beamformers used to achieve the resulting signal.

Figure 7A:
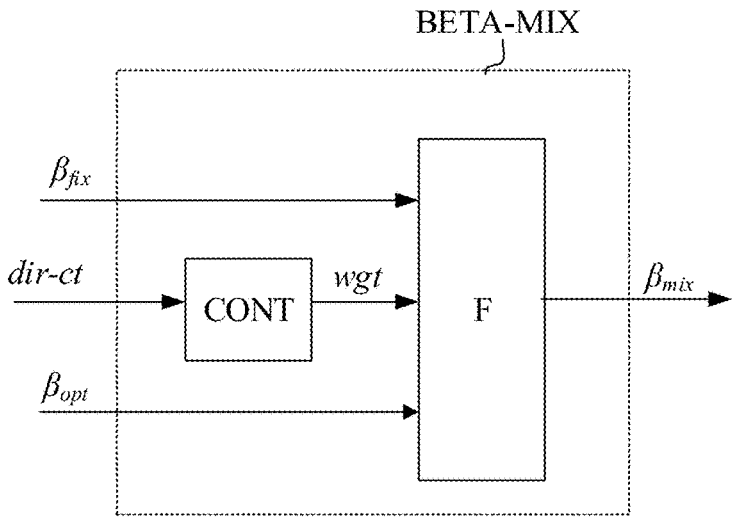
FIG. 7A shows a first embodiment of a mixing unit of an adaptive beamformer filtering unit according to the present disclosure.

FIG. 7A shows a first embodiment of a mixing unit (BETA-MIX) of an adaptive beamformer filtering unit for providing a resulting adaptation parameter $\beta_{mix}(k)$ according to the present disclosure. The mixing unit comprises a function unit (F) that implements a functional relationship f between the resulting adaptation parameter $\beta_{mix}(k)$ and the fixed frequency dependent adaptation parameter $\beta_{fix}(k)$ and the adaptively determined frequency dependent adaptation parameter $\beta_{opt}(k)$, $\beta_{mix}(k)=f(\beta_{opt}(k), \beta_{fix}(k))$, e.g. $f(\beta_{opt}(k), \beta_{fix}(k), \alpha)$, where $\alpha$ is a (e.g. real) weighting parameter. The function unit (F) is controlled by control unit (CONT), which provides a weighting control input wgt to the function unit (F). The weighting control input wgt may be predetermined or based on directional control signal dir-ct from directional control unit (DIR-CTR), cf. e.g. FIG. 6D.

Figure 7B:
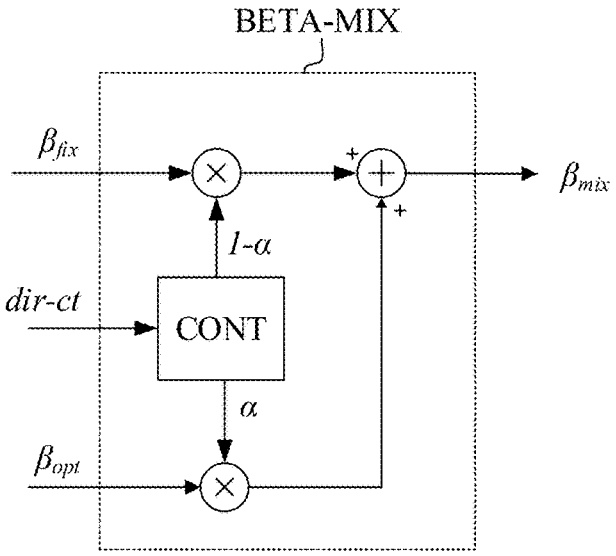
FIG. 7B shows a second embodiment of a mixing unit of an adaptive beamformer filtering unit according to the present disclosure.

FIG. 7B shows a second embodiment of a mixing unit (BETA-MIX) of an adaptive beamformer filtering unit according to the present disclosure. The embodiment of FIG. 7B implements a specific functional relationship $f$ as described above in connection with FIG. 4A:

$$\beta_{mix}=\alpha\beta_{opt}+(1-\alpha)\beta_{fix},$$

where $\alpha$ is a weight between 0 and 1. Alternatively, the application of weights $\alpha$ and $(1-\alpha)$ to adaptation parameters $\beta_{opt}$ and $\beta_{fix}$ may be switched, without any principal difference in functionality (substitute $\alpha'=1-\alpha$, $1-\alpha'=\alpha$). This weight may be a fixed value (e.g. stored in memory) or it could be adaptively controlled depending on e.g. input level, estimated signal-to-noise ratio, an estimate of the noise floor, a voice activity detector, own voice, target-to-jammer ratio or other internal or external detectors, e.g. one or more detectors for estimating the user's present cognitive load, e.g. the amount of sound the user has been exposed to over a time period. The dependence of the weight $\alpha$ is controlled by directional control signal dir-ct via control unit (CONT) resulting in weights $\alpha$ and $1-\alpha$, which are applied to the fixed frequency dependent adaptation parameter $\beta_{fix}(k)$ and to the adaptively determined frequency dependent adaptation parameter $\beta_{opt}(k)$, respectively, by appropriate combination units (here multiplication units ('x') and the resulting functional relationship to determine $\beta_{mix}(k)$ is provided by combination unit '+' (here a summation unit). In an embodiment, the weight $\alpha$ is frequency dependent ($\alpha=\alpha(k)$) and dependent on a current level (L) and/or signal to noise ratio (SNR) of the frequency band k in question, e.g. when speech is detected in the one of the electric input signals. In an embodiment, $\alpha(k, L, SNR)$ approaches 0 for relatively low level and/or high SNR, and approaches 1 for a relatively low SNR and/or a relatively high level.

Figure 8:
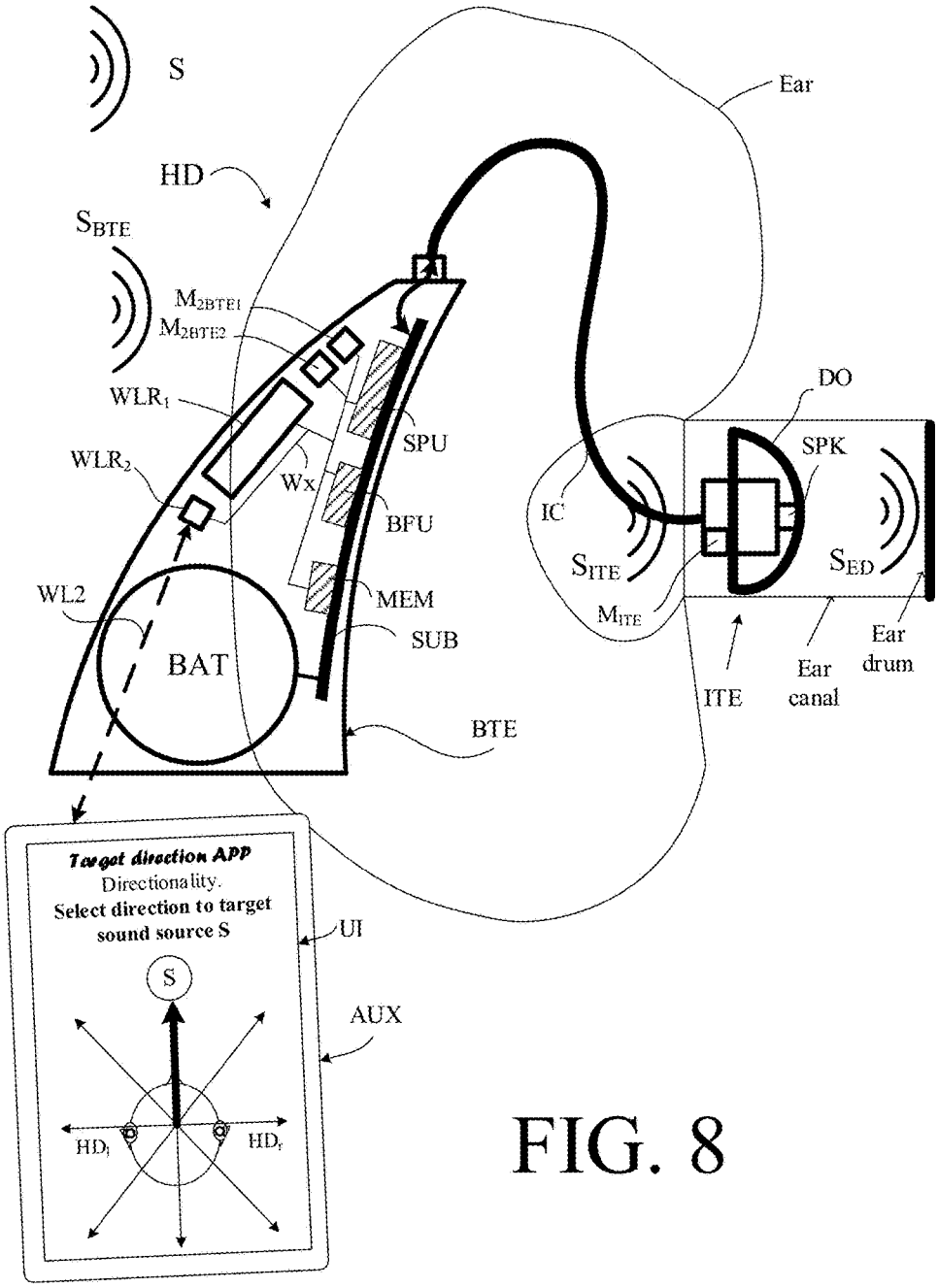
FIG. 8 shows an embodiment of a hearing aid according to the present disclosure comprising a BTE-part located behind an ear or a user and an ITE part located in an ear canal of the user.

FIG. 8 shows an embodiment of a hearing aid according to the present disclosure comprising a BTE-part located behind an ear or a user and an ITE part located in an ear canal of the user. FIG. 8 illustrates an exemplary hearing aid (HD) formed as a receiver in the ear (RITE) type hearing aid comprising a BTE-part (BTE) adapted for being located behind pinna and a part (ITE) comprising an output transducer (OT, e.g. a loudspeaker/receiver) adapted for being located in an ear canal (Ear canal) of the user (e.g. exemplifying a hearing aid (HD) as shown in FIG. 9A, 9B). The BTE-part (BTE) and the ITE-part (ITE) are connected (e.g. electrically connected) by a connecting element (IC). In the embodiment of a hearing aid of FIG. 8, the BTE part (BTE) comprises two input transducers (here microphones) ($M_{BTE1}$, $M_{BTE2}$) each for providing an electric input audio signal representative of an input sound signal ($S_{BTE}$) from the environment (in the scenario of FIG. 8, from sound source S). The hearing aid of FIG. 8 further comprises two wireless receivers ($WLR_1$, $WLR_2$) for providing respective directly received auxiliary audio and/or information signals. The hearing aid (HD) further comprises a substrate (SUB) whereon a number of electronic components are mounted, functionally partitioned according to the application in question (analogue, digital, passive components, etc.), but including a configurable signal processing unit (SPU), a beamformer filtering unit (BFU), and a memory unit (MEM) coupled to each other and to input and output units via electrical conductors Wx. The mentioned functional units (as well as other components) may be partitioned in circuits and components according to the application in question (e.g. with a view to size, power consumption, analogue vs digital processing, etc.), e.g. integrated in one or more integrated circuits, or as a combination of one or more integrated circuits and one or more separate electronic components (e.g. inductor, capacitor, etc.). The configurable signal processing unit (SPU) provides an enhanced audio signal (cf. signal OUT in FIG. 9A, 9B), which is intended to be presented to a user. In the embodiment of a hearing aid device in FIG. 8, the ITE part (ITE) comprises an output unit in the form of a loudspeaker (receiver) (SPK) for converting the electric signal (OUT) to an acoustic signal (providing, or contributing to, acoustic signal $S_{ED}$ at the ear drum (Ear drum). In an embodiment, the ITE-part further comprises an input unit comprising an input transducer (e.g. a microphone) ($M_{ITE}$) for providing an electric input audio signal representative of an input sound signal $S_{ITE}$ from the environment at or in the ear canal. In another embodiment, the hearing aid may comprise only the BTE-microphones ($M_{BTE1}$, $M_{BTE2}$) In yet another embodiment, the hearing aid may comprise an input unit ($IT_3$) located elsewhere than at the ear canal in combination with one or more input units located in the BTE-part and/or the ITE-part. The ITE-part further comprises a guiding element, e.g. a dome, (DO) for guiding and positioning the ITE-part in the ear canal of the user.

The hearing aid (HD) exemplified in FIG. 8 is a portable device and further comprises a battery (BAT) for energizing electronic components of the BTE- and ITE-parts.

The hearing aid (HD) comprises a directional microphone system (beamformer filtering unit (BFU)) adapted to enhance a target acoustic source among a multitude of acoustic sources in the local environment of the user wearing the hearing aid device. In an embodiment, the directional system is adapted to detect (such as adaptively detect) from which direction a particular part of the microphone signal (e.g. a target part and/or a noise part) originates and/or to receive inputs from a user interface (e.g. a remote control or a smartphone) regarding the present target direction. The memory unit (MEM) comprises predefined (or adaptively determined) complex, frequency dependent constants defining predefined or (or adaptively determined) 'fixed' beam patterns according to the present disclosure, together defining the beamformed signal $Y_{BF}$ (cf. e.g. FIG. 9A, 9B)

The hearing aid of FIG. 8 may constitute or form part of a hearing aid and/or a binaural hearing aid system according to the present disclosure.

The hearing aid (HD) according to the present disclosure may comprise a user interface UI, e.g. as shown in FIG. 8 implemented in an auxiliary device (AUX), e.g. a remote control, e.g. implemented as an APP in a smartphone or other portable (or stationary) electronic device. In the embodiment of FIG. 8, the screen of the user interface (UI) illustrates a Target direction APP. A direction to the present target sound source (S) may be selected from the user interface, e.g. by dragging the sound source symbol to a currently relevant direction relative to the user. The currently selected target direction is the frontal direction as indicated by the bold arrow to the sound source S. The auxiliary device and the hearing aid are adapted to allow communication of data representative of the currently selected direction (if deviating from a predetermined direction (already stored in the hearing aid)) to the hearing aid via a, e.g. wireless, communication link (cf. dashed arrow WL2 in FIG. 8). The communication link WL2 may e.g. be based on far field communication, e.g. Bluetooth or Bluetooth Low Energy (or similar technology), implemented by appropriate antenna and transceiver circuitry in the hearing aid (HD) and the auxiliary device (AUX), indicated by transceiver unit $WLR_2$ in the hearing aid.

FIG. 9A shows a block diagram of a first embodiment of a hearing aid according to the present disclosure. The hearing aid of FIG. 9A comprises a 2-microphone beamformer configuration as e.g. shown in FIG. 6A, 6D, 6E and a signal processing unit (SPU) for (further) processing the beamformed signal $Y_{BF}$ and providing a processed signal OUT. The signal processing unit may be configured to apply a level and frequency dependent shaping of the beamformed signal, e.g. to compensate for a user's hearing impairment. The processed signal (OUT) is fed to an output unit for presentation to a user as a signal perceivable as sound. In the embodiment of FIG. 9A, the output unit comprises a loudspeaker (SPK) for presenting the processed signal (OUT) to the user as sound. The forward path from the microphones to the loudspeaker of the hearing aid may be operated in the time domain. The hearing aid may further comprise a user interface (UI) and one or more detectors (DET) allowing user inputs and detector inputs to be received by the beamformer filtering unit (BFU). Thereby an adaptive functionality of the resulting adaptation parameter $\beta_{mix}$ may be provided.

FIG. 9B shows a block diagram of a second embodiment of a hearing aid according to the present disclosure. The hearing aid of FIG. 9B is similar in functionality to the hearing aid of FIG. 9A, also comprising a 2-microphone beamformer configuration as e.g. shown in FIG. 6A, 6D, 6E, but the signal processing unit (SPU) for (further) processing the beamformed signal $Y_{BF}(k)$ is configured to process the beamformed signal $Y_{BF}(k)$ in a number (K) of frequency bands and providing a processed signal OU(k), k=1, 2, . . . , K. The signal processing unit may be configured to apply a level and frequency dependent shaping of the beamformed signal, e.g. to compensate for a user's hearing impairment. The processed frequency band signals OU(k) are fed to a synthesis filter bank FBS for converting the frequency band signals OU(k) to a single time-domain processed (output) signal OUT, which is fed to an output unit for presentation to a user as a stimulus perceivable as sound. In the embodiment of FIG. 9B, the output unit comprises a loudspeaker (SPK) for presenting the processed signal (OUT) to the user as sound. The forward path from the microphones ($M_1$, $M_2$) to the loudspeaker (SPK) of the hearing aid is (mainly) operated in the time-frequency domain (in K frequency bands).

Figure 10:
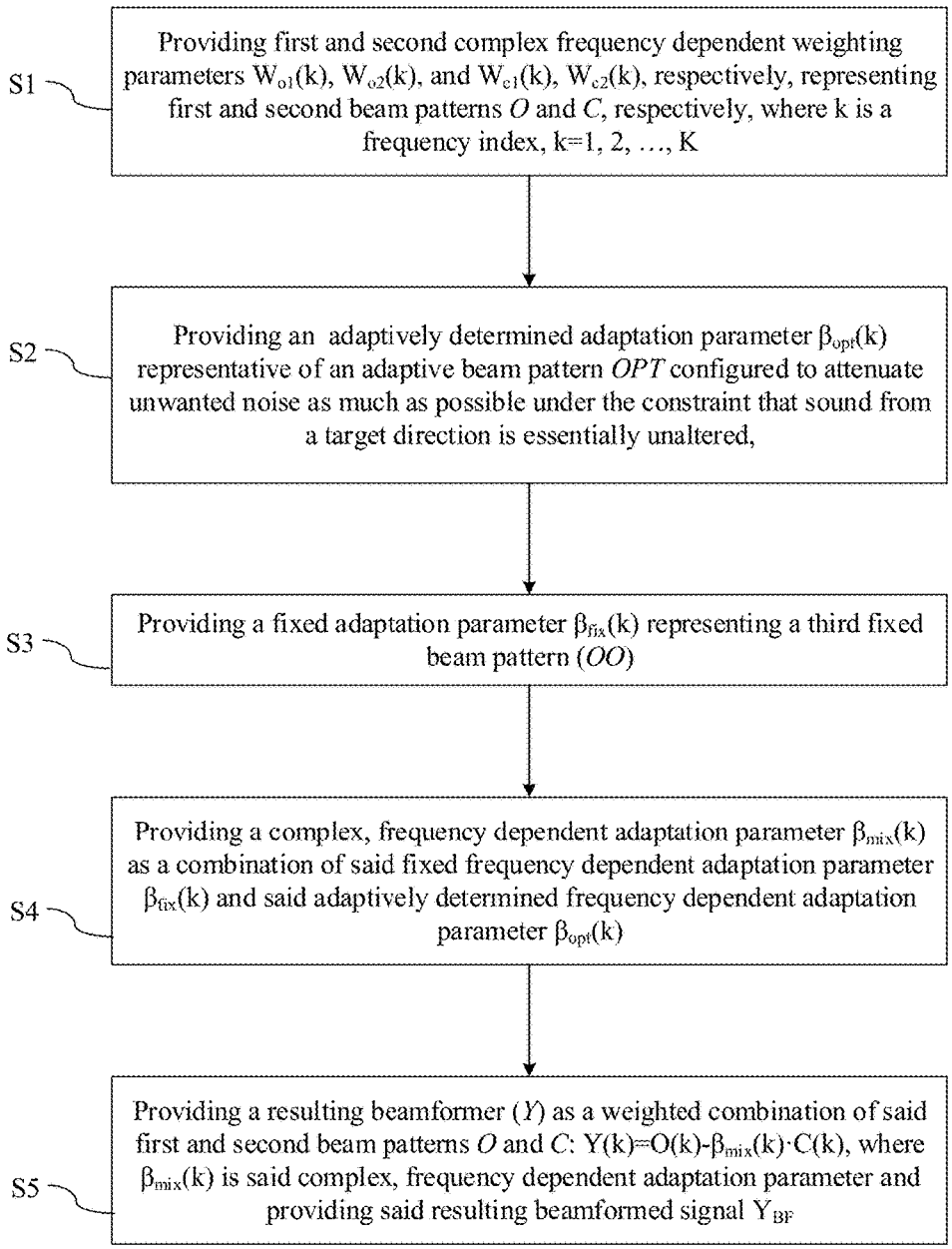
FIG. 10 shows a flow diagram of a method of constraining an adaptive beamformer for providing a resulting beamformed signal $Y_{BF}$ of a hearing aid according to an embodiment of the present disclosure.

FIG. 10 shows a flow diagram of a method of constraining an adaptive beamformer for providing a resulting beamformed signal $Y_{BF}$ of a hearing aid. The method comprises S1. Providing first and second complex frequency dependent weighting parameters $W_{o1}(k)$, $W_{o2}(k)$, and $W_{c1}(k)$, $W_{c2}(k)$, respectively, representing first and second beam patterns O and C, respectively, where k is a frequency index, k=1, 2, . . . , K, S2. Providing an adaptively determined adaptation parameter $\beta_{opt}(k)$ representative of an adaptive beam pattern (OPT) configured to attenuate unwanted noise as much as possible under the constraint that sound from a target direction is essentially unaltered by the adaptation parameter $\beta_{opt}(k)$, S3. Providing a fixed adaptation parameter $\beta_{fix}(k)$ representing a third fixed beam pattern (OO), S4. Providing a complex, frequency dependent adaptation parameter $\beta_{mix}(k)$ as a combination of said fixed frequency dependent adaptation parameter $\beta_{fix}(k)$ and said adaptively determined frequency dependent adaptation parameter $\beta_{opt}(k)$, S5. Providing a resulting beamformer (Y) as a weighted combination of said first and second beam patterns O and C: $Y(k)=O(k)-\beta_{mix}(k)\cdot C(k)$, where $\beta_{mix}(k)$ is said complex, frequency dependent adaptation parameter and providing said resulting beamformed signal $Y_{BF}$, It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2701145A1 (Retune DSP, Oticon) 26.02.2014

US2010196861A1 (Oticon) 05.08.2010

[Jensen & Pedersen; 2015] J. Jensen and M. S. Pedersen, "Analysis of Beamformer Directed Single-Channel Noise Reduction System for Hearing Aid Applications," Proc. Int. Conf. Acoust., Speech, Signal Processing, pp. 5728-5732, April 2015.

The invention claimed is:

1. A hearing aid adapted for being located in an operational position at or in or behind an ear or filly or partially implanted in the head of a user, the hearing aid comprising:

first and second microphones ($M_1$, $M_2$; $M_{BTE1}$, $M_{BTE2}$) for converting an input sound to first $IN_1$ and second $IN_2$ electric input signals, respectively;

an adaptive beamformer filter for providing a resulting beamformed signal $Y_{BF}$, based on said first and second electric input signals, the adaptive beamformer filter comprising, a first memory comprising a first set of complex frequency dependent weighting parameters $W_{o1}(k)$, $W_{o2}(k)$ representing a first beam pattern (O), where k is a frequency index, k=1, 2, . . ., K.

a second memory comprising a second set of complex frequency dependent weighting parameters $W_{c1}(k)$, $W_{c2}(k)$ representing a second beam pattern (C), where said first and second sets of weighting parameters $W_{o1}(k)$, $W_{o2}(k)$ and $W_{c1}(k)$, $W_{c2}(k)$, respectively, are predetermined initial values or values updated during operation of the hearing aid, an adaptive beamformer processor for providing an adaptively determined adaptation parameter $\beta_{opt}(k)$ representing an adaptive beam pattern (OPT) configured to attenuate unwanted noise under the constraint that sound from a target direction is essentially unaltered, a third memory comprising a fixed adaptation parameter $\beta_{fix}(k)$ representing a third, fixed beam pattern (OO), a mixer configured to provide a resulting complex, frequency dependent adaptation parameter $\beta_{mix}(k)$ as a combination of said fixed frequency dependent adaptation parameter $\beta_{fix}(k)$ and said adaptively determined frequency dependent adaptation parameter $\beta_{opt}(k)$, a resulting beamformer (Y) for providing said resulting beamformed signal $Y_{BF}$ based on said first and second electric input signals $IN_1$ and $IN_2$, said first and second sets of complex frequency dependent weighting parameters $W_{o1}(k)$. $W_{o2}(k)$ and $W_{c1}(k)$, $W_{c2}(k)$, and said resulting complex, frequency dependent adaptation parameter $\beta_{mix}(k)$.

2. A hearing aid according to claim 1 wherein said adaptively determined adaptation parameter $\beta_{opt}(k)$ and said fixed adaptation parameter $\beta_{fix}(k)$ are based on said first and second sets of complex frequency dependent weighting parameters $W_{o1}(k)$, $W_{o2}(k)$ and $W_{c1}(k)$, $W_{c2}(k)$, respectively.

3. A hearing aid according to claim 1 comprising a controller for dynamically controlling the relative weighting of the fixed and adaptively determined adaptation parameters $\beta_{fix}(k)$ and $\beta_{opt}(k)$, respectively,

4. A hearing aid according to claim 1 wherein said resulting beamformed signal $Y_{BF}$ is determined according to the following expression:

$$Y_{BF}=IN_1(k)\cdot(W_{o1}(k)^*-\beta_{mix}(k)\cdot W_{c1}(k)^*)+IN_2(k)\cdot(W_{o2}(k)^*-\beta_{mix}(k)\cdot W_{c2}(k)^*),$$

where * denotes complex conjugation.

5. A hearing aid according to claim 1 wherein said first beam pattern (O) represents the beam pattern of a delay and sum beamformer and wherein said second beam pattern (C) represents a beam pattern of a delay and subtract beamformer (C).

6. A hearing aid according to claim 1 configured to provide that the direction to the target signal source relative to a predefined direction is configurable.

7. A hearing aid according to claim 1 where the first and second sets of weighting parameters $W_{o1}(k)$, $W_{o2}(k)$ and $W_{c1}(k)$, $W_{c2}(k)$, respectively, are updated during operation of the hearing aid.

8. A hearing aid according to claim 1 wherein the adaptive beamformer processor is configured to determine the adaptation parameter $\beta_{opt}(k)$ from the following expression $$\beta_{opt} = \frac{\langle C * O\rangle}{\langle |C|^2\rangle},$$

where * denotes complex conjugation, and <·> denotes the statistical expectation operator.

9. A hearing aid according to claim 1 wherein the adaptive beamformer processor is configured to determine the adaptation parameter $\beta_{opt}(k)$ from the following expression $$\beta_{opt} = \frac{w_O^H C_v w_C}{w_C^H C_v w_C},$$

where $w_O$ and $w_C$ are the beamformer weights for the delay and sum O and the delay and subtract C beamformers, respectively, $C_v$ is the noise covariance matrix, and H denotes Hermetian transposition.

10. A hearing aid according to claim 1 wherein the third, fixed beam pattern (OO) is configured to provide a fixed beam pattern having a desired directional shape suitable for listening to sounds from all directions.

11. A hearing aid according to claim 1 wherein the resulting adaptation parameter $\beta_{mix}$ is determined as a linear combination of the adaptation parameters $\beta_{opt}$ and $\beta_{fix}$ according to the expression $$\beta_{mix}=\alpha\beta_{opt}+(1-\alpha)\beta_{fix},$$

where weighting parameter $\alpha$ is a real number between 0 and 1.

12. A hearing aid according to claim I wherein the resulting adaptation parameter $\beta_{mix}$ is determined as belonging to points on a circle in the complex plane, or an approximation thereof.

13. A hearing aid according to claim 11 wherein the weighting parameter $\alpha$ is a function of a current acoustic environment and/or of a present cognitive load of the user.

14. A hearing aid according to claim 1 comprising a hearing instrument, a headset, an earphone, an ear protection device or a combination thereof.

15. A method of constraining an adaptive beamformer for providing a resulting beamformed signal $Y_{BF}$ of a hearing aid from first $IN_1$, and second $IN_2$, electric input signals, the method comprising storing, in memory, first and second complex frequency dependent weighting parameters $W_{o1}(k)$, $W_{o2}(k)$, and $W_{c1}(k)$, $W_{c2}(k)$, respectively, representing first and second beam patterns O and C, respectively, where k is a frequency index, k=1, 2, . . ., K, adaptively determining, using an adaptive beamformer processor, an adaptation parameter $\beta_{opt}(k)$ representing an adaptive beam pattern (OPT) configured to attenuate unwanted noise under the constraint that sound from a target direction is essentially unaltered, storing, in memory, a fixed adaptation parameter $\beta_{fix}(k)$ representing a third fixed beam pattern (OO), providing, using a mixer, a complex, frequency dependent adaptation parameter $\beta_{mix}(k)$ as a combination of said fixed frequency dependent adaptation parameter $\beta_{fix}(k)$ and said adaptively determined frequency dependent adaptation parameter $\beta_{opt}(k)$, providing a resulting beamformer (Y) as a weighted combination of said first and second beam patterns O and C: $Y(k)=O(k)-\beta_{mix}(k)\cdot C(k)$, where $\beta_{mix}(k)$ is said complex, frequency dependent adaptation. parameter, and using the resulting beamformer in the hearing aid for providing said resulting beamformed signal $Y_{BF}$ from the first $IN_1$ and second $IN_2$ electric input signals.

16. A data processing system comprising a processor and program code for causing the processor to perform the steps of the method of claim 15.

17. A non-transitory computer-readable medium having stored there on a program comprising instructions which, when the program is executed by a computer, causes the computer to carry out the method of claim 15.

* * * * *